US011814255B2

(12) United States Patent
Migita et al.

(10) Patent No.: US 11,814,255 B2
(45) Date of Patent: Nov. 14, 2023

(54) MEDIUM-TRANSPORTING DEVICE AND IMAGE READING APPARATUS

(71) Applicant: SEIKO EPSON CORPORATION, Tokyo (JP)

(72) Inventors: Koji Migita, Matsumoto (JP); Kazuya Yoshikaie, Kitakyushu (JP); Hiromichi Kitsuki, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 66 days.

(21) Appl. No.: 17/453,922

(22) Filed: Nov. 8, 2021

(65) Prior Publication Data

US 2022/0144568 A1 May 12, 2022

(30) Foreign Application Priority Data

Nov. 9, 2020 (JP) ..... 2020-186388
Apr. 22, 2021 (JP) ..... 2021-072398

(51) Int. Cl.
*B65H 3/06* (2006.01)
*B65H 7/02* (2006.01)
*B65H 7/18* (2006.01)

(52) U.S. Cl.
CPC ..... *B65H 3/0684* (2013.01); *B65H 3/0669* (2013.01); *B65H 7/02* (2013.01); *B65H 7/18* (2013.01); *B65H 2511/13* (2013.01); *B65H 2513/51* (2013.01)

(58) Field of Classification Search
CPC ..... B65H 3/0669; B65H 3/0684; B65H 7/02; B65H 7/14; B65H 7/18; B65H 2511/13; B65H 2513/51; B65H 2513/512
See application file for complete search history.

(56) References Cited

U.S. PATENT DOCUMENTS

2003/0090053 A1* 5/2003 Hsiao ..... B65H 3/0684 271/118
2006/0038339 A1* 2/2006 Shimamura ..... B65H 3/56 271/121
2018/0305147 A1* 10/2018 Kuriki ..... B65H 3/0676
2019/0291981 A1* 9/2019 Yoshita ..... B65H 3/0676
2020/0307930 A1* 10/2020 Okamoto ..... B65H 1/04
2021/0130119 A1* 5/2021 Migita ..... B65H 3/5215

FOREIGN PATENT DOCUMENTS

JP 2010-070367 A 4/2010

* cited by examiner

*Primary Examiner* — Prasad V Gokhale
(74) *Attorney, Agent, or Firm* — WORKMAN NYDEGGER

(57) ABSTRACT

A medium-transporting device includes: a medium-mounting section on which a medium is mounted; a feeding unit that includes a feeding roller and that is configured to be displaced between a contact posture and a separation posture; a first restricting member that is provided downstream of the feeding roller in the transport direction and that is configured to switch between a restriction posture in which the first restricting member restricts movement of the medium and a retreat posture in which the first restricting member permits the movement of the medium; a first motor configured to generate power for rotating the feeding roller; and a second motor configured to generate power for switching a posture of the first restricting member, in which an operation of rotating the feeding roller and an operation of switching the first restricting member from the restriction posture to the retreat posture are performed in parallel.

10 Claims, 26 Drawing Sheets

MEDIUM-TRANSPORTING DEVICE AND IMAGE READING APPARATUS

The present application is based on, and claims priority from JP Application Serial Number 2020-186388, filed Nov. 9, 2020 and JP Application Serial Number 2021-072398, filed Apr. 22, 2021, the disclosures of which are hereby incorporated by reference herein in their entirety.

BACKGROUND

1. Technical Field

The present disclosure relates to a medium-transporting device that transports a medium and an image reading apparatus that reads an image of the medium transported by the medium-transporting device.

2. Related Art

JP-A-2010-70367 describes an image reading apparatus including an abutting member that abuts a sheet mounted on a sheet mounting section, for example, to position the sheet and a feeding member that feeds the sheet. The abutting member is driven by a drive source for rotationally driving the feeding member.

According to the configuration for medium transport in JP-A-2010-70367, when the drive source rotates forward, the abutting member retreats from a transport path, and when the drive source then rotates in reverse, the feeding member feeds a sheet, which is a medium. Thus, when the sheet is fed, to perform an operation of retreating the abutting member and an operation of rotating the feeding member, the drive source is to be switched between forward rotation and reverse rotation, which takes time and which may extend FCOT (first copy output time). Note that FCOT is the time required for the first medium to be discharged after a transport job is input to an apparatus.

SUMMARY

A medium-transporting device includes: a medium-mounting section on which a medium is mounted; a feeding unit that includes a feeding roller for feeding the medium mounted on the medium-mounting section in a transport direction and that is configured to be displaced between a contact posture in which the feeding roller comes into contact with the medium mounted on the medium-mounting section and a separation posture in which the feeding roller separates from the medium; a restricting member that is provided downstream of the feeding roller in the transport direction and that is configured to switch between a restriction posture in which the restricting member restricts movement of the medium and a retreat posture in which the restricting member permits the movement of the medium; a first motor configured to generate power for rotating the feeding roller; and a second motor configured to generate power for switching a posture of the restricting member, in which an operation of rotating the feeding roller and an operation of switching the restricting member from the restriction posture to the retreat posture are performed in parallel.

An image reading apparatus includes the medium-transporting device described above and a reading section configured to read an image of the medium which is transported.

DESCRIPTION OF EXEMPLARY EMBODIMENTS

1. First Embodiment

Configurations of a medium-transporting device 30 and an image reading apparatus 20 according to a first embodiment will be described.

Figure 1:
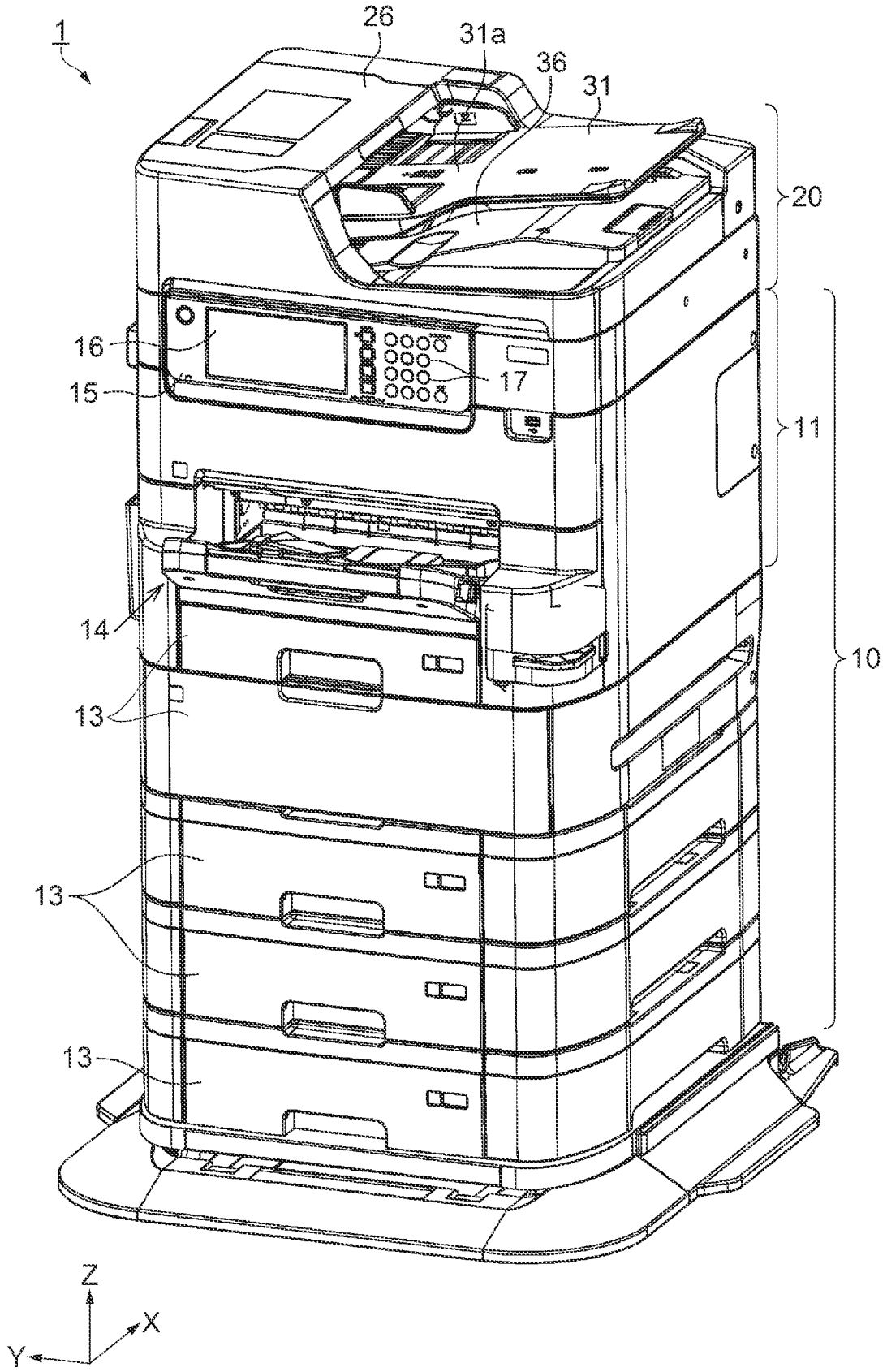
FIG. 1 is a perspective view illustrating a multi-functional peripheral including an image reading apparatus of a first embodiment.

FIG. 1 illustrates a multi-functional peripheral 1 including the image reading apparatus 20 of the present embodiment. The multi-functional peripheral 1 includes an image forming apparatus 10 that forms an image on a medium, the image reading apparatus 20, and an operation section 15 for operating the image forming apparatus 10.

Note that the X-Y-Z coordinate system described in the drawings and embodiments is as follows.

The X direction is a depth direction of the multi-functional peripheral 1. The +X direction is a direction from the front to the rear of the multi-functional peripheral 1, and the −X direction is a direction from the rear to the front of the multi-functional peripheral 1.

Note that, in the image reading apparatus 20, the X direction is a direction intersecting the Y direction described later and intersecting a transport direction of a medium.

The Y direction is a width direction of the multi-functional peripheral 1. The +Y direction is a direction from the right to the left from the view of a user facing the front of the multi-functional peripheral 1, and the −Y direction is a direction from the left to the right from the view of the user facing the front of the multi-functional peripheral 1. Note that the Y direction is a direction extending in the transport direction in which the medium is transported in the image reading apparatus 20.

The Z direction is a height direction of the multi-functional peripheral 1 and the vertical direction. The +Z direction is the vertically up direction, and the −Z direction is the vertically down direction.

The operation section 15 includes a touch panel 16 that displays a setting screen for an image reading operation and an image forming operation and that receives input from the user and includes a plurality of buttons 17. The multi-functional peripheral 1 receives input from the operation section 15 and performs the image reading operation in the image reading apparatus 20 and the image forming operation in the image forming apparatus 10.

The image forming apparatus 10 includes a medium-storage section 13 that stores a medium for image formation, a main body section 11 that has an image forming section (not illustrated) for forming an image on the medium, and a medium-discharging section 14 on which the medium having the image formed thereon is mounted.

A plurality of medium-storage sections 13 are provided in a lower portion of the image forming apparatus 10. The main body section 11 is provided above the medium-storage sections 13. The image forming section (not illustrated) forms an image on the medium transported from the medium-storage section 13. The medium having the image formed thereon is discharged to the medium-discharging section 14 provided on a side surface of the main body section 11.

Next, the image reading apparatus 20 will be described.

As illustrated in FIG. 1, the image reading apparatus 20 is provided on the image forming apparatus 10. The image reading apparatus 20 includes the medium-transporting device 30 that transports a medium P for image reading on a transport path 300 partially indicated by the broken line in FIG. 2 and includes a reading device 21 that reads an image of the transported medium P and generates image data. Note that the transport path 300 is a path from a medium-mounting section 31 described later to a discharge section 36. In the following description, a position on the medium-mounting section 31 side and a position on the discharge section 36 side when viewed from a certain member in the transport direction of the medium P are referred to as upstream and downstream, respectively.

Figure 2:
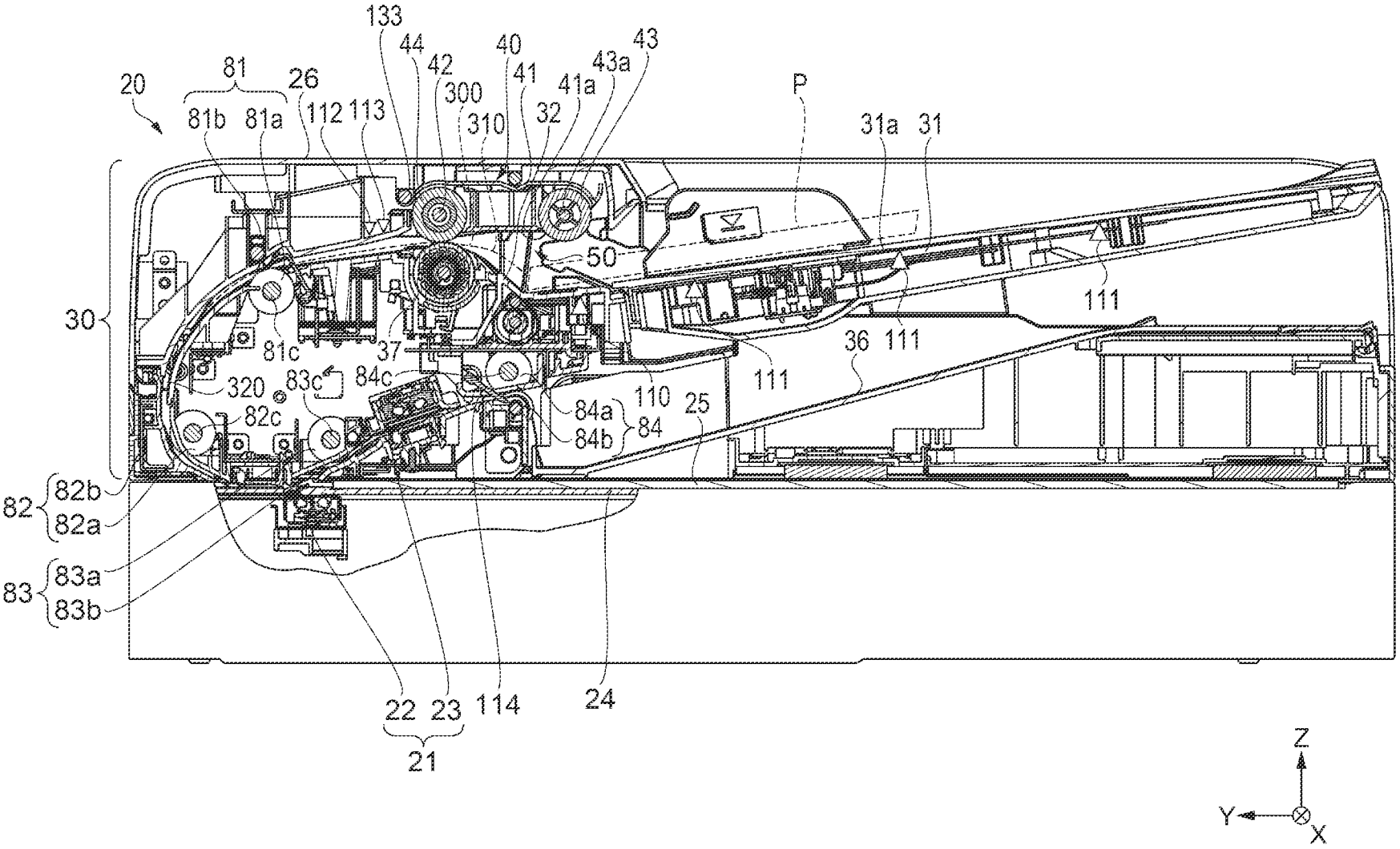
FIG. 2 is a sectional view illustrating the image reading apparatus.

The reading device 21 includes a first reading section 22 for reading a first side of the medium P transported on the transport path 300 and a second reading section 23 for reading a second side of the medium P. As the first reading section 22 and the second reading section 23 in the present embodiment, for example, an optical reading section adopting a CIS (contact image sensor) system, a CCD (charge coupled device) system, or the like is used. As illustrated in FIG. 2, the first reading section 22 is provided below a document platen 24, on which the medium P is mounted to enable the first side of the medium P to be read, and is configured to be movable in the Y direction. The document platen 24 is made of, for example, colorless transparent glass.

The second reading section 23 is provided downstream of the first reading section 22 on the transport path 300 and reads the second side of the medium P.

The medium-transporting device 30 is openable/closable with respect to the document platen 24, and opening the medium-transporting device 30 exposes the document platen 24. A pressing plate 25 that presses the medium P, which is mounted on the document platen 24, from above is provided on the lower surface of the medium-transporting device 30. In a state in which the medium P is mounted on the document platen 24 and is pressed by the pressing plate 25 in response to the medium-transporting device 30 being closed, when the first reading section 22 moves in the Y direction, an image of the medium P is able to be read.

The medium-transporting device 30 includes the medium-mounting section 31 on which the medium P before being transported is mounted. A mounting surface 31*a* of the medium-mounting section 31 is inclined downward toward the +Y side. Note that a plurality of media P are able to be mounted on the mounting surface 31*a* in a layered manner.

The medium-transporting device 30 includes a feeding unit 40 that feeds, onto the transport path 300, the uppermost medium P of the plurality of media P mounted on the mounting surface 31*a* and a transport guide 32 positioned at an opposite side of the transport path 300 from the feeding unit 40.

As illustrated in FIG. 2, the transport guide 32 has an inclined surface inclined upward toward the +Y side and guides the fed medium P in the transport direction.

The medium-transporting device 30 includes a plurality of pairs of transport rollers 81, 82, 83, and 84 arranged downstream of the feeding unit 40 in the transport direction. The pairs of transport rollers 81, 82, 83, and 84 correspond to transport rollers and include a drive roller 81*a* and a driven roller 81*b*, a drive roller 82*a* and a driven roller 82*b*, a drive roller 83*a* and a driven roller 83*b*, and a drive roller 84*a* and a driven roller 84*b*, respectively. The plurality of pairs of transport rollers 81, 82, 83, and 84 transport the medium P downstream in the transport direction on the transport path 300.

The discharge section 36 to which the medium P the image of which has been read by the reading device 21 is discharged is provided below the medium-mounting section 31 in the medium-transporting device 30. That is, the medium P is transported from the mounting surface 31*a* in the +Y direction and is discharged in the −Y direction via a curved path 320.

The medium-transporting device 30 includes an upper unit 26. The upper unit 26 is openable/closable with respect to a main body of the medium-transporting device 30, and opening the upper unit 26 enables a portion of the transport path 300 to be exposed.

Figure 3:
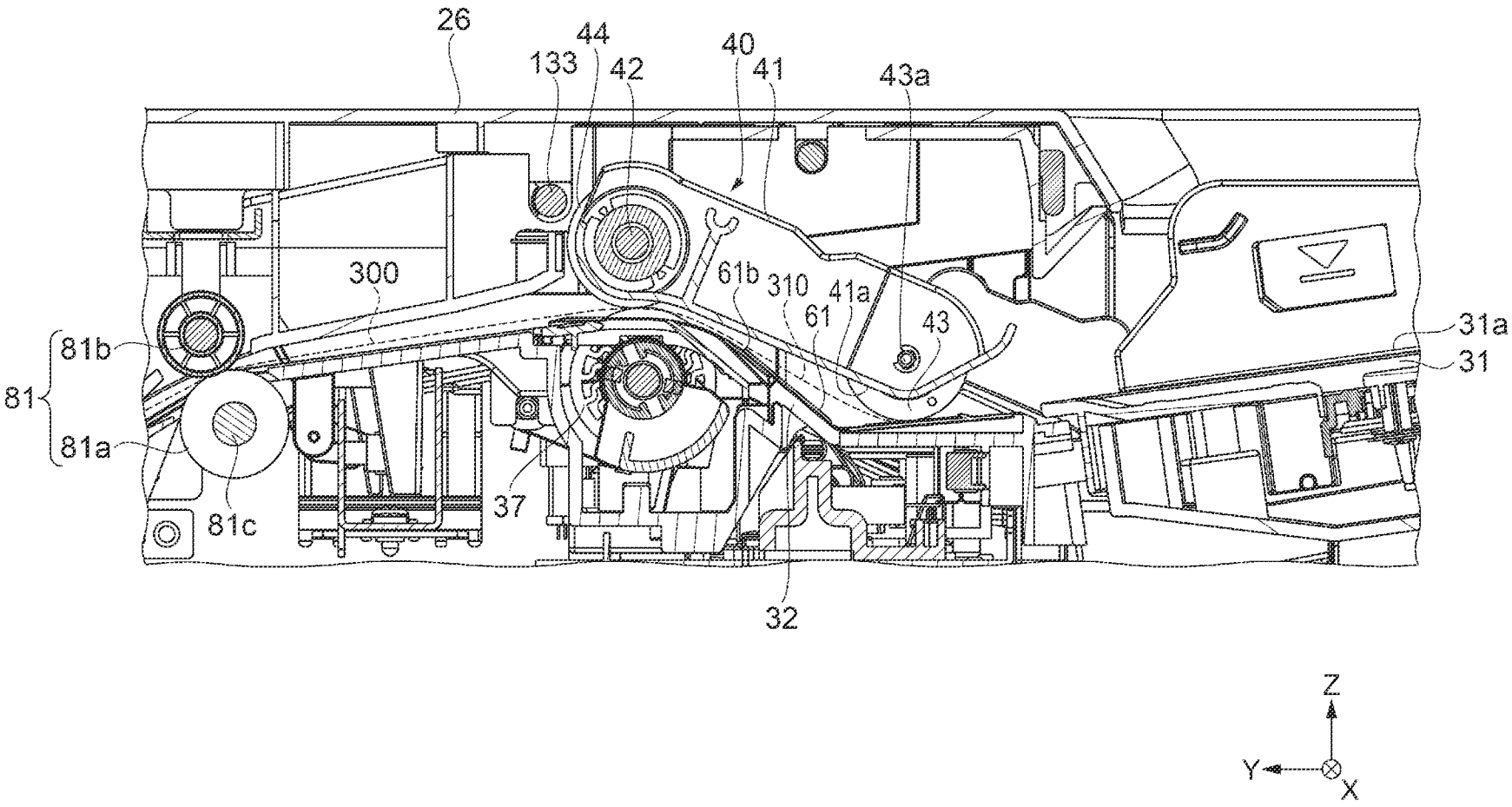
FIG. 3 is a sectional view illustrating a portion of the image reading apparatus in an enlarged manner.
Figure 4:
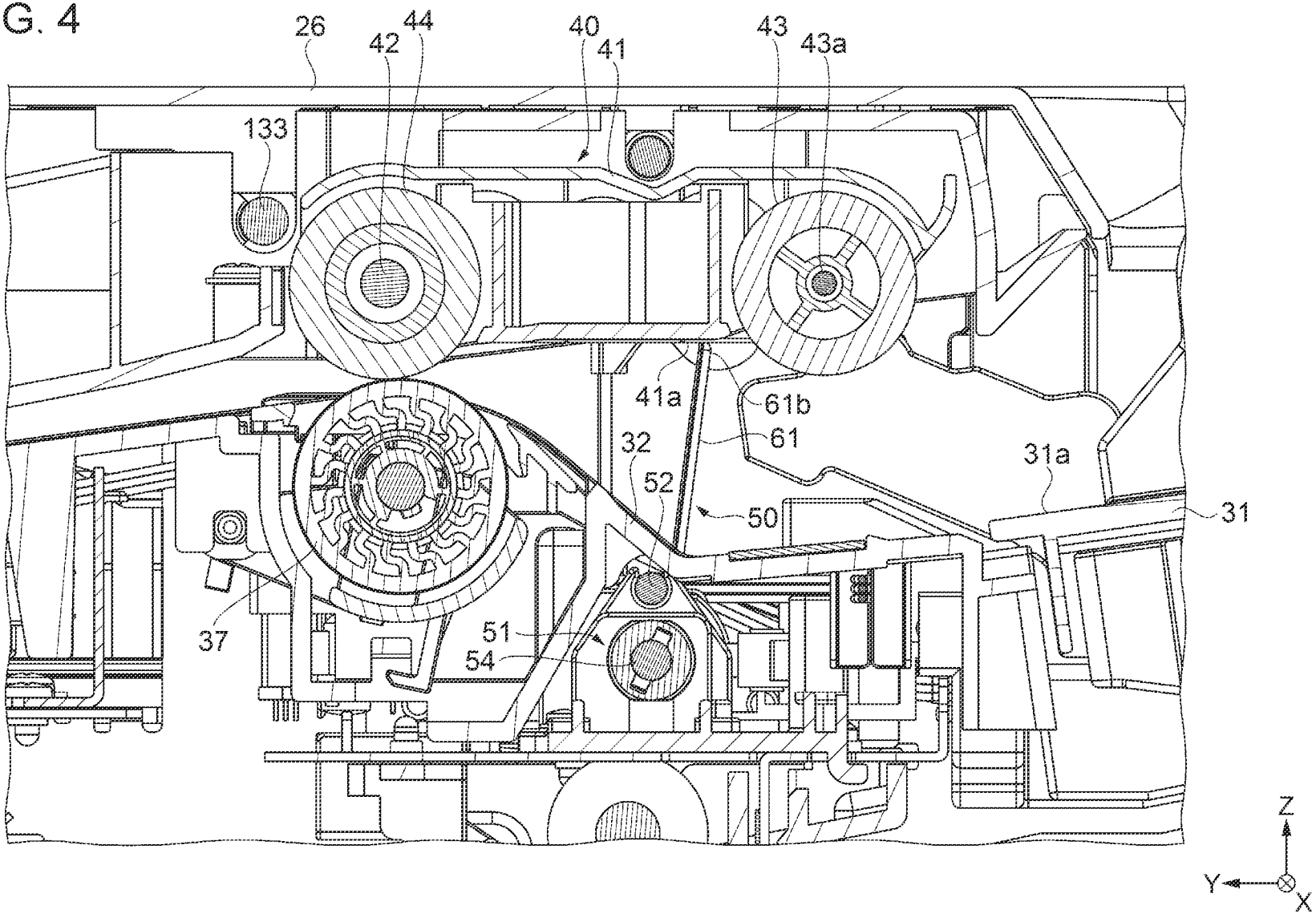
FIG. 4 is a sectional view illustrating a portion of the image reading apparatus in an enlarged manner.

The feeding unit 40 is attached to the upper unit 26. The feeding unit 40 includes a feeding unit main body 41 provided in the center of the transport path 300 in the X direction, which is a medium-width direction. The feeding unit main body 41 is attached to the upper unit 26 in a state of being pivotable via a unit rotational shaft 42 extending in the X direction. The unit rotational shaft 42 is arranged downstream of the medium-mounting section 31 in the transport direction. The feeding unit main body 41 extends from the unit rotational shaft 42 in the −Y direction. As illustrated in FIGS. 3 and 4, the feeding unit main body 41 is able to be displaced between a contact posture in which a feeding roller 43 described later is able to come into contact with the medium P mounted on the mounting surface 31*a* and a separation posture in which the feeding roller 43 retreats from the contact posture in the +Z direction and separates from the medium P.

The feeding unit 40 includes the feeding roller 43 supported in a state of being rotatable about a rotational shaft 43*a* extending in the X direction. The feeding roller 43 is provided in the −Y direction with respect to the unit rotational shaft 42. When the feeding unit main body 41 is at the position at which the contact posture is taken, the feeding roller 43 comes into contact with the medium P mounted on the mounting surface 31*a* and rotates to thereby feed the medium P in the transport direction.

The feeding unit 40 desirably includes a separation roller 44 arranged downstream of the feeding roller 43 in the transport direction. In this case, the separation roller 44 is rotatable about a rotational axis extending in the X direction and is able to come into contact with the medium P transported on the transport path 300. That is, the separation roller 44 is able to hold the medium P against a retard roller 37 supported by the image reading apparatus 20.

Note that the retard roller 37 rotates when a torque greater than or equal to a predetermined value is input but does not rotate when a torque less than the predetermined value is input. Accordingly, when a plurality of media P are fed in an overlapping manner, the separation roller 44 and the retard roller 37 are able to eliminate double-feeding.

In the present embodiment, the separation roller 44 is supported by the unit rotational shaft 42 in a rotatable state. However, the separation roller 44 is not required to be supported by the unit rotational shaft 42 as long as the separation roller 44 is positioned downstream of the feeding roller 43 in the transport direction.

A unit partition surface 41*a*, which corresponds to a contact section, is provided on the lower surface of the feeding unit main body 41 so as to face the transport path 300. When the feeding unit 40 includes the separation roller 44, the unit partition surface 41*a* is arranged between the feeding roller 43 and the separation roller 44 in the transport direction.

Note that a portion of the transport path 300, which faces the feeding unit 40, is referred to as an upstream transport path 310. That is, the upstream transport path 310 corresponds to a portion of the transport path 300, which is between a downstream end of the feeding unit 40 in the transport direction and a downstream end of the medium-mounting section 31 in the transport direction.

As illustrated in FIGS. 2 to 5, the medium-transporting device 30 includes a restricting unit 50 that restricts feeding of the medium P, which is mounted on the medium-mounting section 31, in the transport direction. The restricting unit 50 includes a restricting unit main body 51, a restricting rotational shaft 52, and a rotating spring 53. The restricting unit main body 51 is arranged at an opposite side of the transport guide 32 from the upstream transport path 310. The restricting rotational shaft 52 is a rotational shaft extending in the X direction and is supported by the restricting unit main body 51 in a rotatable state. The respective ends of the rotating spring 53 are attached to the restricting unit main body 51 and the restricting rotational shaft 52.

Figure 5:
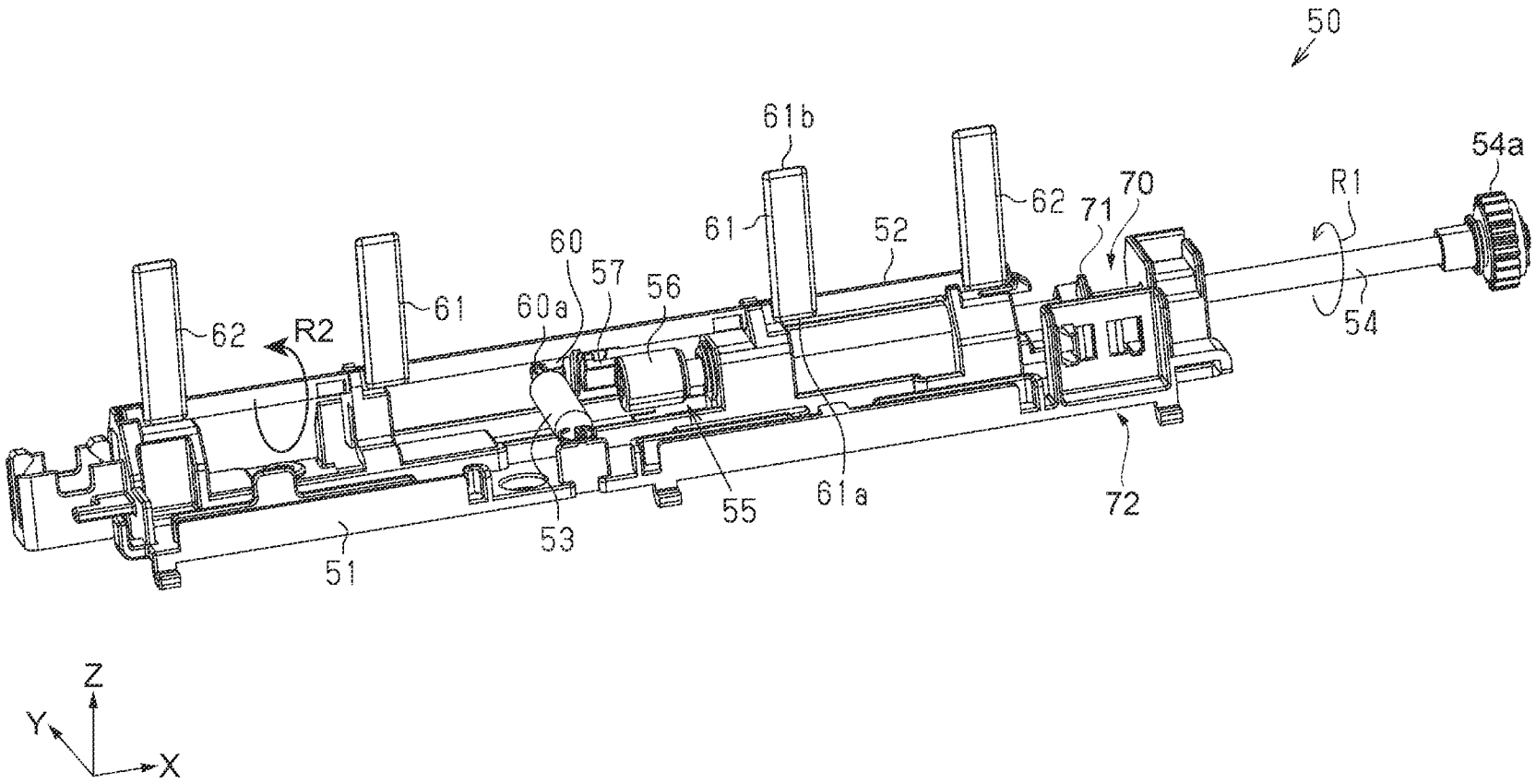
FIG. 5 is a perspective view illustrating a restricting unit of the image reading apparatus.

As illustrated in FIG. 5, the restricting unit main body 51 is fixed to the image reading apparatus 20 so as to extend in the X direction in which the restricting rotational shaft 52 also extends. Note that the extending direction of the restricting unit main body 51 may deviate slightly from the extending direction of the restricting rotational shaft 52. The restricting unit main body 51 supports, in a rotatable state, a restricting drive shaft extending in the X direction in which the restricting rotational shaft 52 also extends.

Figure 6:
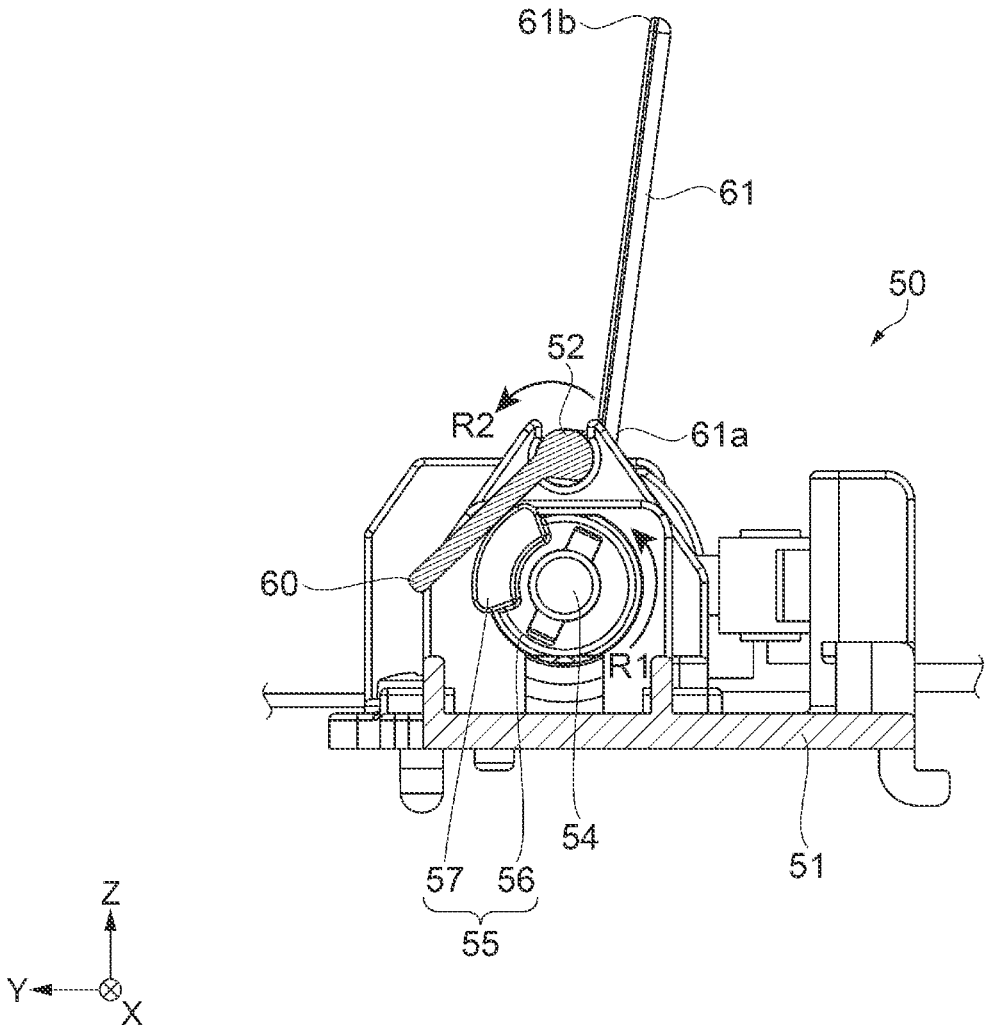
FIG. 6 is a sectional view of the restricting unit.
Figure 7:
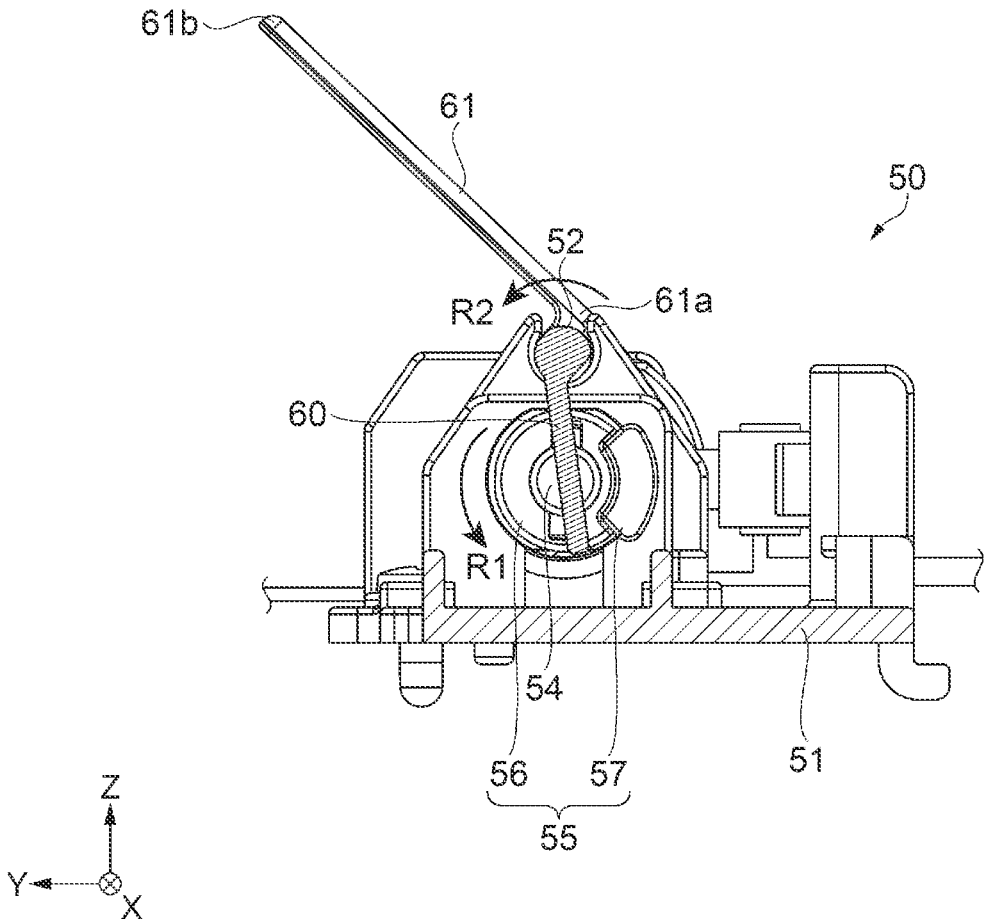
FIG. 7 is a sectional view of the restricting unit.

As illustrated in FIGS. 5 to 7, the restricting drive shaft 54 extends in the X direction and rotates in a predetermined rotational direction R1. The first end of the restricting drive shaft 54 in the +X direction is positioned outside the restricting unit main body 51. On the other hand, the second end of the restricting drive shaft 54 in the −X direction is positioned inside the restricting unit main body 51. A drive gear 54*a* is attached to the first end of the restricting drive shaft 54. On the other hand, a rotation restricting section 55 is attached to the second end of the restricting drive shaft 54.

The rotation restricting section 55 is coupled to the restricting drive shaft 54 in an integrally rotatable state. The rotation restricting section 55 includes a cylindrical insert-receiving section 56 through which the restricting drive shaft 54 is inserted and a protruding section 57 attached to an outer surface of the insert-receiving section 56 in a radial direction.

The rotating spring 53 urges the restricting rotational shaft 52 such that the restricting rotational shaft 52 rotates in a rotational direction R2 illustrated in FIG. 6. However, when the protruding section 57 of the rotation restricting section 55 is at the position illustrated in FIG. 6, the protruding section 57 comes into contact with a pressed section 60 provided at the restricting rotational shaft 52, which will be described later, thereby restricting rotation of the restricting rotational shaft 52. On the other hand, when the protruding section 57 is not in contact with the pressed section 60 as illustrated in FIG. 7, rotation of the restricting rotational shaft 52 in the rotational direction R2 in response to the force from the rotating spring 53 is permitted.

The pressed section 60 is a plate-like member coupled to the restricting rotational shaft 52 in an integrally rotatable state. As illustrated in FIG. 5, the pressed section 60 includes a support portion 60*a* that supports the rotating spring 53. Thus, the force from the rotating spring 53 is input to the pressed section 60 via the support portion 60*a*.

As illustrated in FIG. 6, when the protruding section 57 is in contact with the pressed section 60, rotation of the pressed section 60 and the restricting rotational shaft 52 in the rotational direction R2 is restricted. On the other hand, when the protruding section 57 is not in contact with the pressed section 60 as illustrated in FIG. 7, the rotating spring 53 urges the pressed section 60, and the pressed section 60 and the restricting rotational shaft 52 thus rotate in the rotational direction R2.

As illustrated in FIG. 5, a first restricting member 61, which corresponds to a restricting member, is coupled to the restricting rotational shaft 52 in an integrally rotatable state. As illustrated in FIG. 5, the first restricting member 61 is a plate-like member extending from the restricting rotational shaft 52 in one direction. The end of the first restricting member 61 in the longitudinal direction, which is coupled to the restricting rotational shaft 52, is a base end 61*a*, and the end opposite thereto is a tip end 61*b*. Note that, in the present embodiment, two first restricting members 61 are provided in the X direction so as to be symmetrical with respect to the center of the medium P in the width direction, but two or more first restricting members 61 may be provided.

Figure 9:
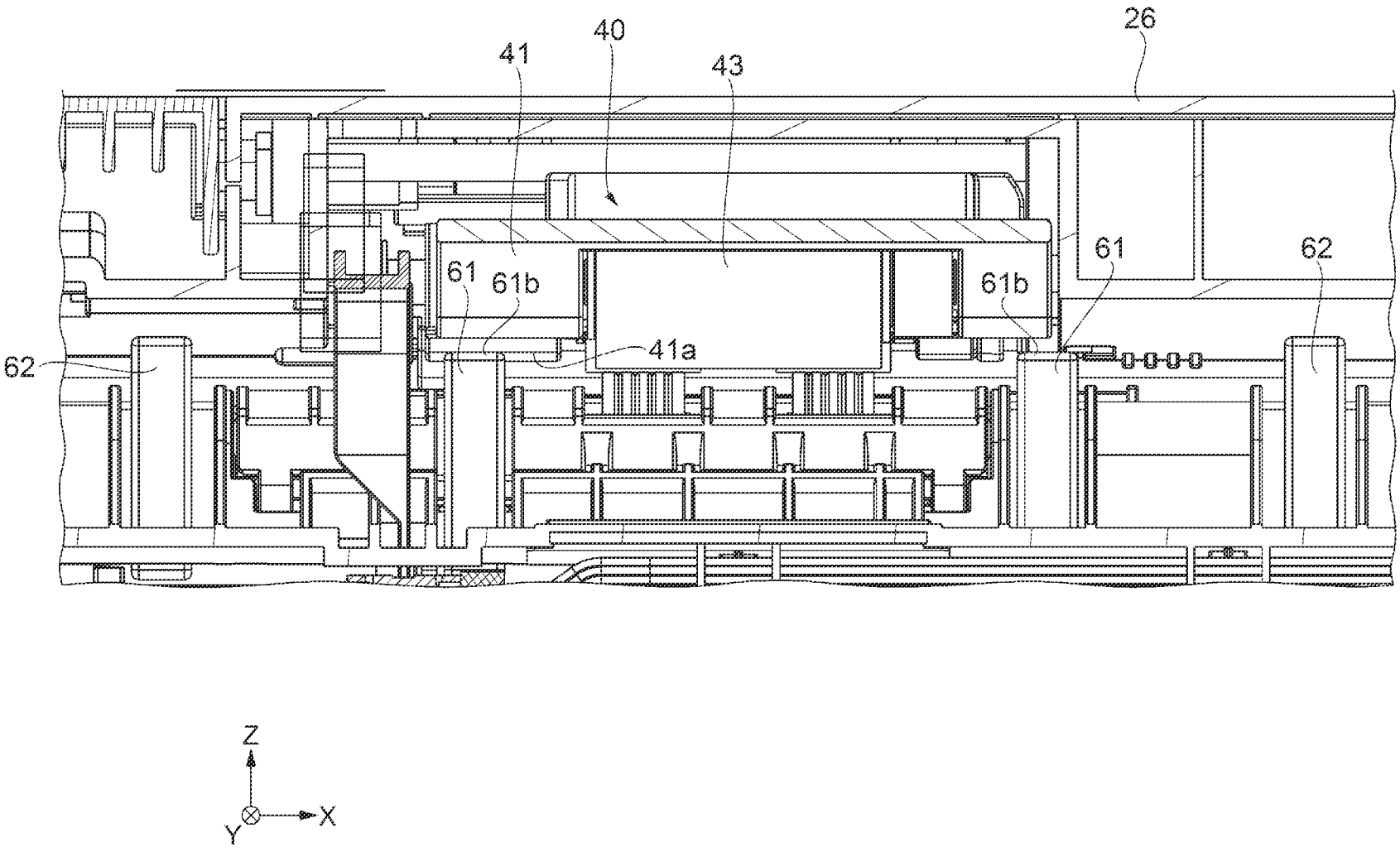
FIG. 9 is a sectional view illustrating a portion of the image reading apparatus.

As illustrated in FIGS. 3 and 4, the first restricting member 61 is provided downstream of the feeding roller 43 in the transport direction of the medium P. Moreover, as illustrated in FIG. 9, the first restricting member 61 is arranged at a position capable of coming into contact with the unit partition surface 41*a* of the feeding unit main body 41 in the X direction. The first restricting member 61 rotates between a position at which a restriction posture is taken in which the first restricting member 61 restricts movement of the medium P in the transport direction as illustrated in FIG. 6 and a position at which a retreat posture is taken in which the first restricting member 61 permits movement of the medium P in the transport direction as illustrated in FIG. 7. When the first restricting member 61 is in the restriction posture, the pressed section 60 is in contact with the protruding section 57 as illustrated in FIG. 6. When the restricting drive shaft 54 rotates in the rotational direction R1 to terminate the contact state of the pressed section 60 and the protruding section 57, the restricting rotational shaft 52 rotates in the rotational direction R2. As a result, the first restricting member 61 rotates from the position at which the restriction posture is taken toward the position at which the retreat posture is taken.

Figure 8:
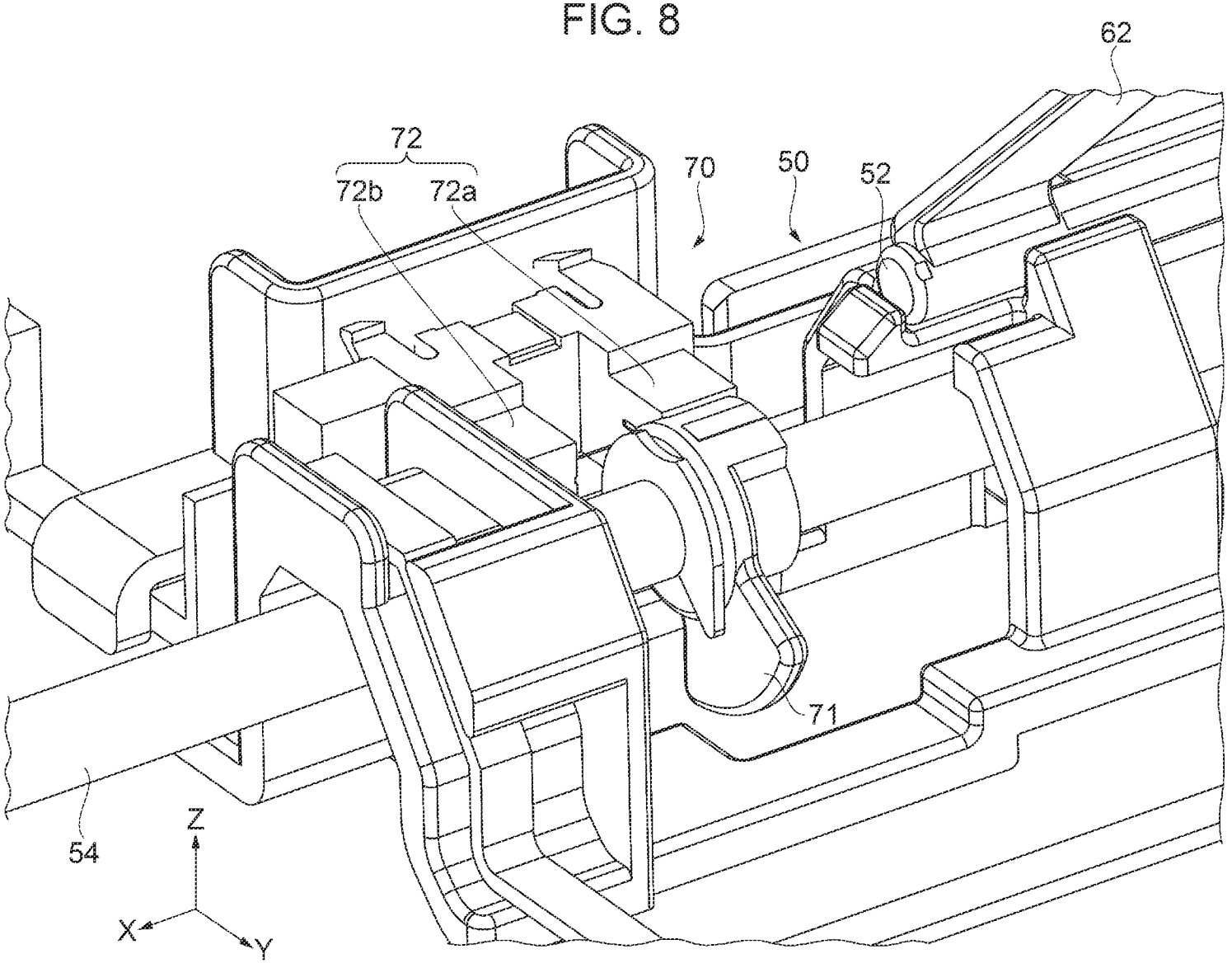
FIG. 8 is a perspective view illustrating a portion of the restricting unit in an enlarged manner.

As illustrated in FIG. 8, the restricting unit 50 includes a rotation detecting unit 70 that detects rotation of the restricting drive shaft 54. The rotation detecting unit 70 includes a detecting section 72 attached to the restricting unit main body 51 and a light-shielding member 71 attached to the restricting drive shaft 54 in an integrally rotatable manner. The detecting section 72 includes a light-emitting section 72*a* and a light-receiving section 72*b* that receives light emitted from the light-emitting section 72*a*. The light-shielding member 71 rotates integrally with the restricting drive shaft 54 and advances to or retreats from a space between the light-emitting section 72*a* and the light-receiving section 72*b*. When the light-shielding member 71 is positioned between the light-emitting section 72*a* and the light-receiving section 72*b*, the light-shielding member 71 shields against light traveling from the light-emitting section 72*a* to the light-receiving section 72*b*. The rotation detecting unit 70 is able to detect the position of the light-shielding member 71 by detecting the light-receiving state of the detecting section 72 and detect rotation of the restricting drive shaft 54.

The rotation detecting unit 70 is able to determine the posture of the first restricting member 61. As illustrated in FIG. 6, when the protruding section 57 is in contact with the pressed section 60 and when the first restricting member 61 is in the restriction posture, the light-shielding member 71 is positioned between the light-emitting section 72*a* and the light-receiving section 72*b*. On the other hand, as illustrated in FIGS. 7 and 8, when the protruding section 57 is not in contact with the pressed section 60 and when the first restricting member 61 is in the retreat posture, the light-shielding member 71 is at a position different from the position between the light-emitting section 72*a* and the light-receiving section 72*b*. That is, the rotation detecting unit 70 is able to determine the posture of the first restricting member 61 by detecting the position of the light-shielding member 71.

As illustrated in FIG. 4, when the first restricting member 61 is in the restriction posture, a leading end of the medium P mounted on the medium-mounting section 31 comes into contact with the first restricting member 61, thus the first restricting member 61 restricts movement of the medium P mounted on the mounting surface 31*a* in the transport direction.

On the other hand, as illustrated in FIG. 3, the first restricting member 61 in the retreat posture is laid down along the transport guide 32. In this case, movement of the medium P mounted on the mounting surface 31*a* in the transport direction is permitted.

Next, the posture of the first restricting member 61 and the posture of the feeding unit 40 will be described.

As illustrated in FIG. 4, when the first restricting member 61 is in the restriction posture, the feeding unit 40 is held at the position at which the separation posture is taken. When the first restricting member 61 is in the restriction posture, the tip end 61*b* of the first restricting member 61 is in contact with the unit partition surface 41*a*. Accordingly, the feeding unit 40 is held at the position at which the separation posture is taken.

Moreover, as illustrated in FIG. 3, when the first restricting member 61 is in the retreat posture, the feeding unit 40 takes the contact posture. When the first restricting member 61 is in the retreat posture, the tip end 61*b* of the first restricting member 61 is not in contact with the unit partition surface 41*a*. Accordingly, the weight of the feeding unit 40 causes the feeding unit 40 to move to the position at which the contact posture is taken.

That is, when the first restricting member 61 switches from the restriction posture to the retreat posture, the feeding unit 40 is displaced from the separation posture to the contact posture. When switching from the retreat posture to the restriction posture, the first restricting member 61 comes into contact with the unit partition surface 41*a* and lifts the feeding unit 40 to the position of the separation posture from the contact posture. That is, switching the posture of the first restricting member 61 displaces the posture of the feeding unit 40.

Note that, in the present embodiment, even when the first restricting member 61 is in the retreat posture as illustrated in FIG. 3, the tip end 61*b* of the first restricting member 61 is positioned on the upstream transport path 310. At this time, the tip end 61*b* of the first restricting member 61 is desirably positioned closer to the transport guide 32 than is the unit partition surface 41*a* of the feeding unit 40 in the Z direction. As a result, a space through which the medium P passes is able to be ensured between the tip end 61*b* of the first restricting member 61 and the unit partition surface 41*a*.

Note that, when the first restricting member 61 is in the retreat posture, the tip end 61*b* of the first restricting member 61 is not required to be positioned on the upstream transport path 310. That is, the tip end 61*b* of the first restricting member 61 may be positioned below the transport guide 32.

As described above, the restricting rotational shaft 52 is positioned below the transport guide 32, whereas the tip end 61*b* of the first restricting member 61 is positioned on the upstream transport path 310. Accordingly, the transport guide 32 includes a first insertion hole (not illustrated) as an insertion hole into which the first restricting member 61 is inserted.

Note that, as illustrated in FIGS. 5 and 9, the restricting unit 50 desirably includes a second restricting member 62, which corresponds to a restricting member. In the present embodiment, the second restricting member 62 is arranged on each side of the first restricting members 61 in the X direction. Similarly to the first restricting member 61, the second restricting member 62 is supported by the restricting rotational shaft 52 in an integrally rotatable state. When the first restricting member 61 is in the restriction posture, the second restricting member 62 takes the restriction posture, and when the first restricting member 61 is in the retreat posture, the second restricting member 62 takes the retreat posture.

Note that the transport guide 32 includes a second insertion hole (not illustrated) into which the second restricting member 62 is inserted.

Next, the configuration of a control section 100 included in the image reading apparatus 20 will be described with reference to FIG. 10.

Figure 10:
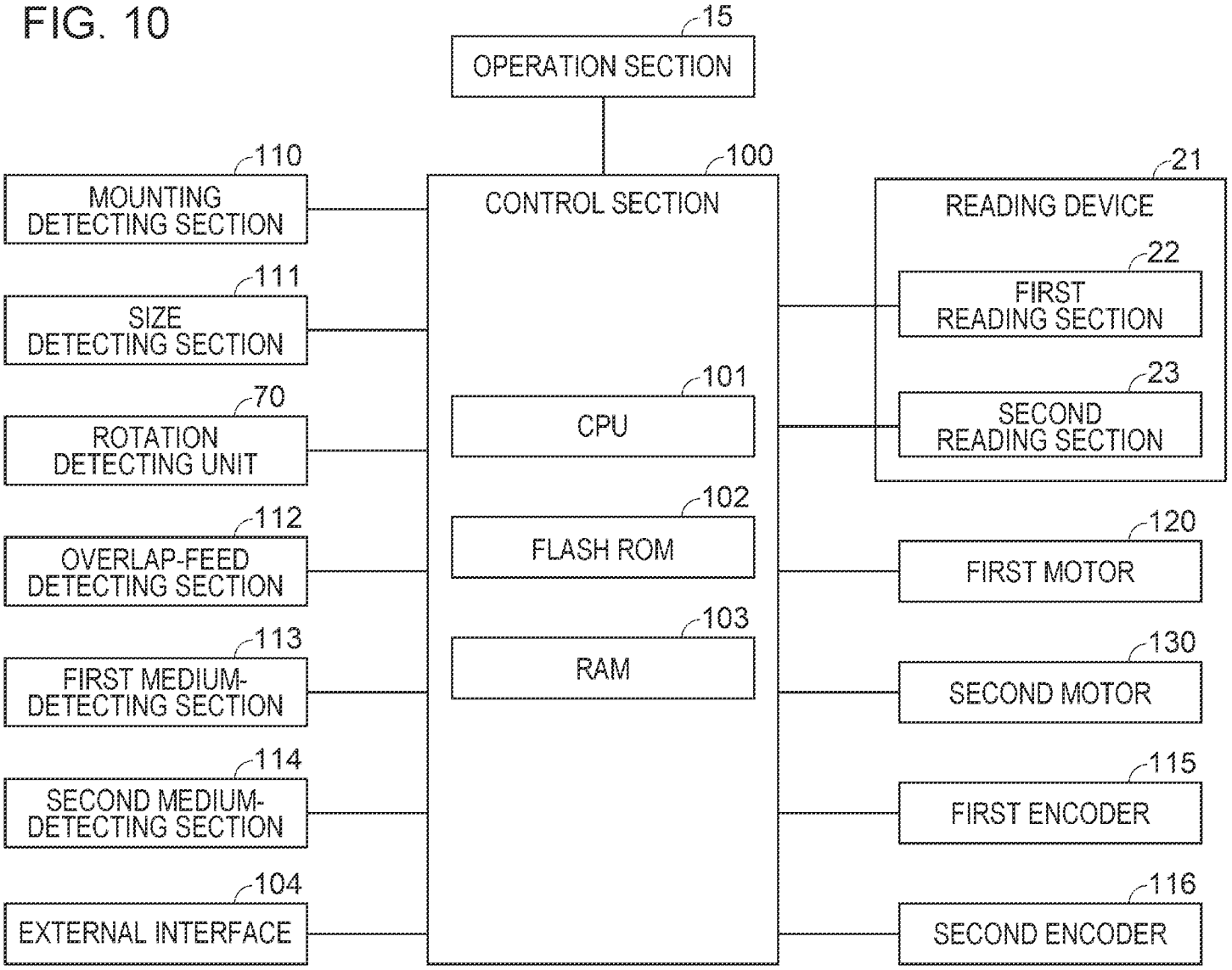
FIG. 10 is a block diagram of a control system of the image reading apparatus.

As illustrated in FIG. 10, the control section 100 includes a CPU 101, flash ROM 102, and RAM 103. The CPU 101 performs various kinds of computational processing in accordance with a program stored in the flash ROM 102 and controls the operation of the image reading apparatus 20. The flash ROM 102, which is an example of a storage unit, is readable-and-writable non-volatile memory. Various kinds of setting information input by the user via the operation section 15 are stored in the flash ROM 102. Various kinds of information are temporarily stored in the RAM 103, which is an example of a storage unit. The control section 100 is able to communicate with an external device via an external interface 104 in a wired or wireless manner.

The control section 100 controls the first reading section 22 and the second reading section 23 included in the reading device 21. The control section 100 generates image data in accordance with an image read by the first reading section 22 and the second reading section 23.

In addition to the rotation detecting unit 70 described above, a mounting detecting section 110, a size detecting section 111, an double-feeding detecting section 112, a first medium-detecting section 113, a second medium-detecting section 114, a first encoder 115, and a second encoder 116 are coupled to the control section 100, and signals from the detecting sections are input to the control section 100. The control section 100 performs necessary control in accordance with the signals.

As illustrated in FIG. 2, the mounting detecting section 110 is provided in the medium-mounting section 31 and detects the presence/absence of the medium P on the medium-mounting section 31. Note that the mounting detecting section 110 is, for example, a contact sensor and comes into contact with the medium P mounted on the medium mounting section 31 to thereby detect the medium P.

The size detecting section 111 is provided in the medium-mounting section 31 and detects the size of the medium P mounted on the medium-mounting section 31. Note that the size detecting section 111 is constituted by a plurality of sensors and specifically includes a plurality of optical sensors arranged with a gap therebetween in the transport direction and a plurality of optical sensors arranged with a gap therebetween in the width direction of the medium P. The control section 100 determines the size of the medium P mounted on the medium-mounting section 31 in accordance with a combination of signals from the plurality of optical sensors of the size detecting section 111.

As illustrated in FIG. 2, the double-feeding detecting section 112, the first medium-detecting section 113, and the second medium-detecting section 114 are provided on the transport path 300.

The first medium-detecting section 113 is provided downstream of the feeding unit 40 on the transport path 300. The second medium-detecting section 114 is provided upstream of the pair of transport rollers 84 on the transport path 300. The first medium-detecting section 113 and the second medium-detecting section 114 are each constituted by, for example, a contact sensor. The control section 100 detects passing of a leading end and a trailing end of the medium P by using the first medium-detecting section 113 and the second medium-detecting section 114.

The double-feeding detecting section 112 is provided downstream of the first medium-detecting section 113. The double-feeding detecting section 112 is, for example, an ultrasonic sensor. The control section 100 is able to detect the presence/absence of double-feeding of media P by using the double-feeding detecting section 112.

Figure 11:
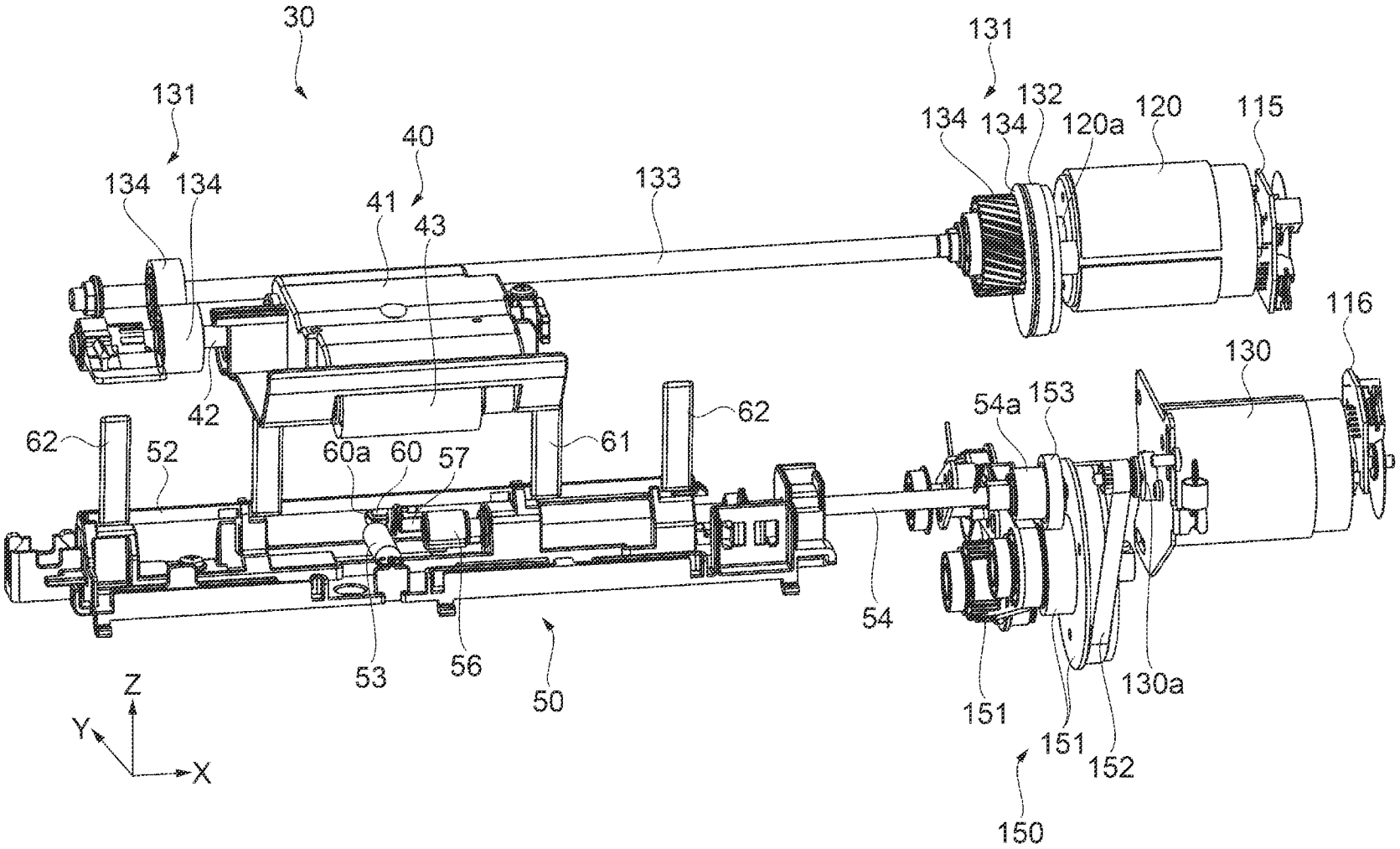
FIG. 11 is a perspective view illustrating a portion of a drive system of the image reading apparatus.

The first encoder 115 is a sensor for detecting rotation of a first motor 120 described later and is coupled directly to the first motor 120 as illustrated in FIG. 11. The control section 100 is able to detect the rotational speed and rotational direction of the first motor 120 in accordance with a pulse signal received from the first encoder 115.

The second encoder 116 is a sensor for detecting rotation of a second motor 130 described later and is coupled directly to the second motor 130 as illustrated in FIG. 11. The control section 100 is able to detect the rotational speed and rotational direction of the second motor 130 in accordance with a pulse signal received from the second encoder 116.

Next, a power transferring system of the medium-transporting device 30 will be described with reference to FIGS. 11 and 12.

The medium-transporting device 30 includes the first motor and the second motor 130. The rotational speed and rotational direction of each of the first motor 120 and the second motor 130 are controlled by the control section 100. An output shaft 120*a* of the first motor 120 and an output shaft 130*a* of the second motor 130 are configured to be rotatable in both forward and reverse directions. The first motor 120 generates power for rotating the feeding roller 43. The second motor 130 generates power for rotating the restricting rotational shaft 52 to switch the posture of each of the restricting members 61 and 62.

Note that, as illustrated in FIG. 11, the first motor 120 and the second motor 130 are provided in a side portion of the medium-transporting device 30 in the +X direction.

Figure 12:
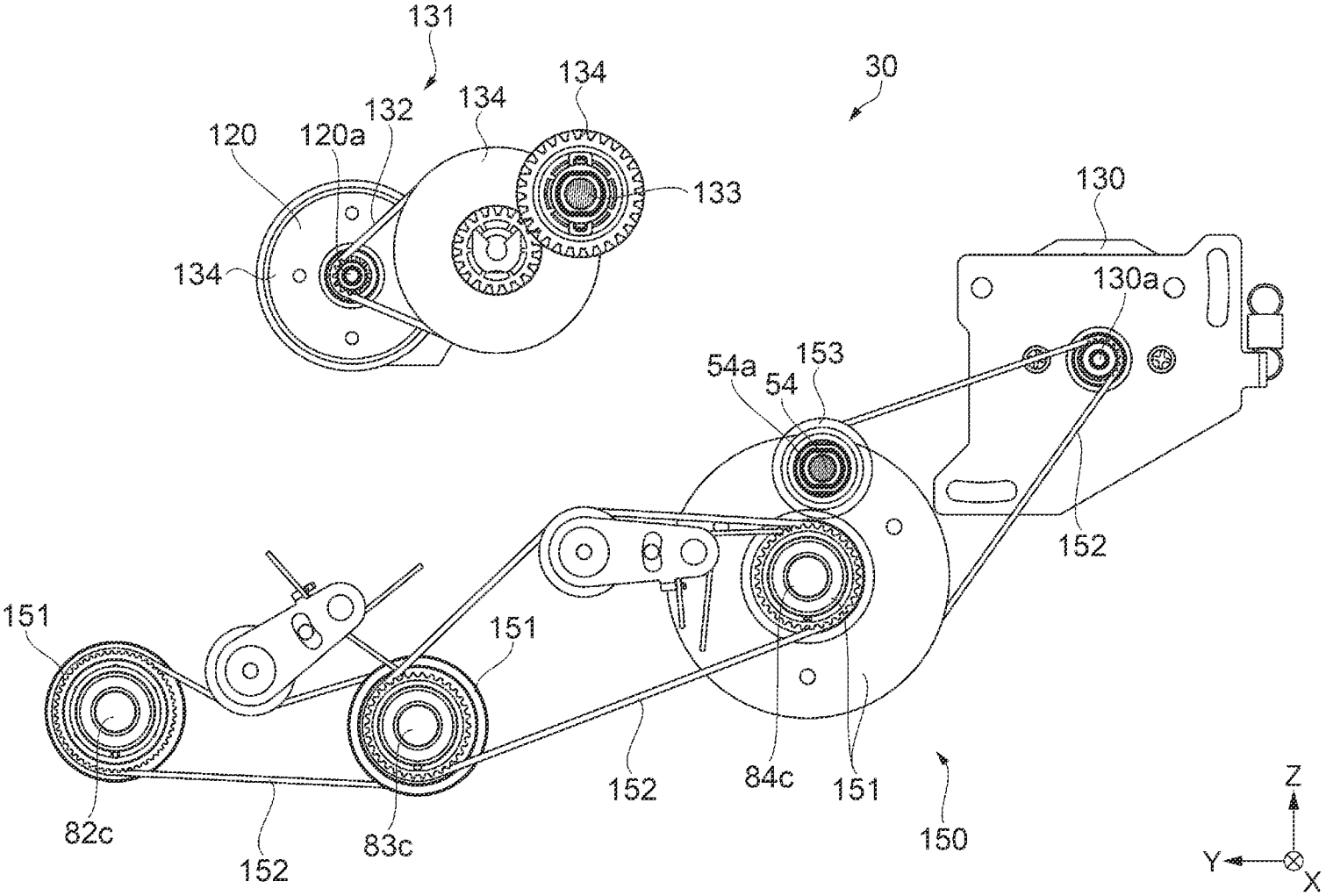
FIG. 12 is a sectional view illustrating a portion of the drive system of the image reading apparatus.
Figure 13:
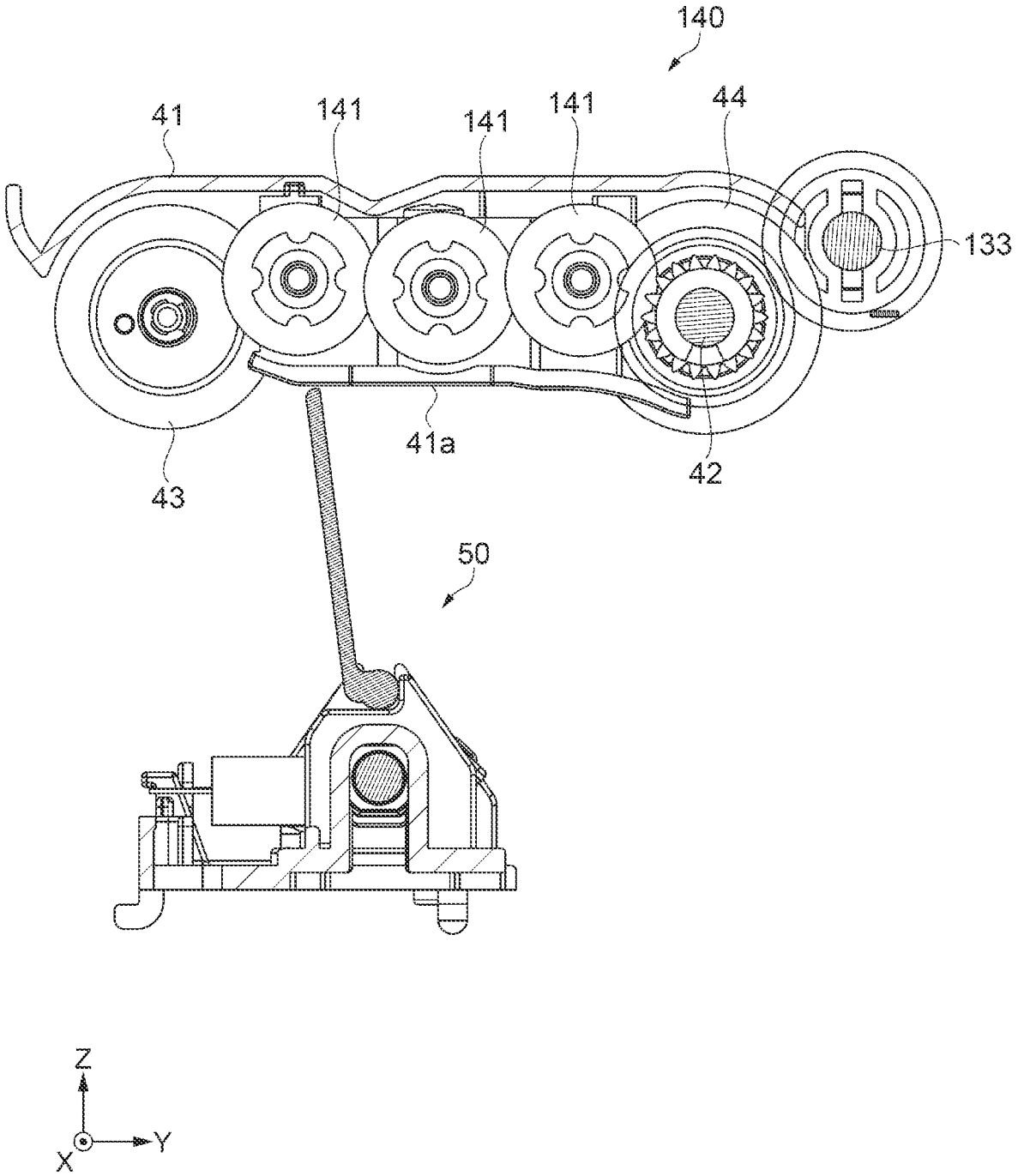
FIG. 13 is a sectional view illustrating a second power transferring unit of the image reading apparatus.

As illustrated in FIGS. 11 and 12, the medium-transporting device 30 includes a first power transferring unit 131 that transfers power of the first motor 120 to the unit rotational shaft 42. The first power transferring unit 131 includes a plurality of gears 134, a power transferring shaft 133, and a belt 132 for transferring power. The power transferring shaft 133 is a rotational shaft provided downstream of the feeding unit 40 in the transport direction and extending in the X direction. Moreover, as illustrated in FIG. 13, a second power transferring unit 140 that transfers rotation of the unit rotational shaft 42 to the feeding roller 43 is provided in a side portion of the feeding unit main body 41. The second power transferring unit 140 includes a plurality of gears 141. According to such a configuration, rotation of the output shaft 120*a* of the first motor 120 in both the forward and reverse directions is transferred to the feeding roller 43 via the first power transferring unit 131 and the second power transferring unit 140. Note that, in the present embodiment, power of the first motor 120 also rotates the separation roller 44 provided on the unit rotational shaft 42.

The second motor 130 generates, in addition to power for switching the posture of each of the restricting members 61 and 62, power for the respective drive rollers 81*a*, 82*a*, 83*a*, and 84*a* of the pairs of transport rollers 81, 82, 83, and 84 arranged downstream of the separation roller 44 on the transport path 300. Specifically, the drive roller 81*a* near the curved path 320, the drive roller 82*a* provided upstream of the first reading section 22 in the transport direction, the drive roller 83*a* between the first reading section 22 and the second reading section 23 in the transport direction, and the drive roller 84*a* near the discharge section 36 are driven by the second motor 130.

As illustrated in FIG. 12, the medium-transporting device 30 includes a third power transferring unit 150 that transfers power of the second motor 130 to the restricting drive shaft 54 and the respective drive rollers 81*a*, 82*a*, 83*a*, and 84*a*. The third power transferring unit 150 includes a plurality of gears 151 coupled to the rotational shafts 82*c*, 83*c*, and 84*c* of the respective drive rollers 82*a*, 83*a*, and 84*a* and a plurality of belts 152 in contact with the gears 151. Note that a rotational shaft 81*c* of the drive roller 81*a* (not illustrated in FIG. 12) is coupled to the rotational shaft 82*c* of the drive roller 82*a* via a gear and a belt, which are not illustrated, in the end of the medium-transporting device 30 in the +X direction.

Moreover, each of the power transferring units of the present embodiment is an example, and power may be transferred by only a gear train.

As illustrated in FIGS. 11 and 12, the third power transferring unit 150 includes a one-way clutch 153 on a transfer path for coupling the drive gear 54*a* of the restricting drive shaft 54. When the output shaft 130*a* of the second motor 130 rotates in reverse, the one-way clutch 153 transfers the power of the second motor 130 to the drive gear 54*a*, and when the output shaft 130*a* of the second motor 130 rotates forward, the one-way clutch 153 does not transfer the power of the second motor 130 to the drive gear 54*a*. That is, when the output shaft 130*a* of the second motor 130 rotates in reverse, the rotation of the second motor 130 is transferred to the restricting drive shaft 54, and the postures of the first restricting member 61 and the second restricting member 62 change. On the other hand, when the output shaft 130*a* of the second motor 130 rotates forward, the one-way clutch 153 interrupts transfer of power, and the postures of the first restricting member 61 and the second restricting member 62 thus do not change.

Note that, when the output shaft 130*a* of the second motor 130 rotates forward, the respective drive rollers 81*a*, 82*a*, 83*a*, and 84*a* to which power is transferred via the rotational shafts 81*c*, 82*c*, 83*c*, and 84*c* rotate so as to feed the medium P in the transport direction. At this time, the one-way clutch 153 does not transfer the power of the second motor 130 to the drive gear 54*a*, thus making it possible to reduce a load on the second motor 130.

Figure 14:
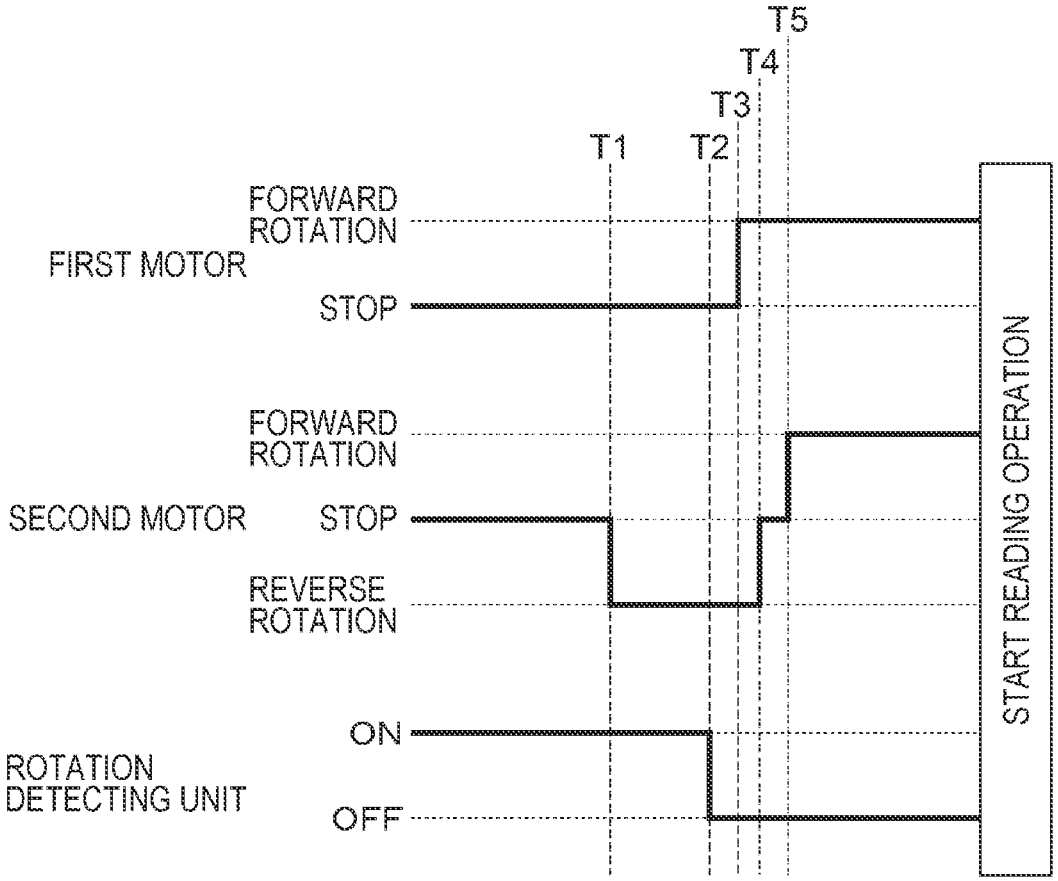
FIG. 14 is a timing chart illustrating operation timings in feeding control.

Next, feeding control of the medium P will be described with reference to the timing chart of FIG. 14 besides the drawings described above.

The control section 100 starts operations of transporting and reading the medium P upon input via the operation section 15 or the external interface 104.

First, the control section 100 causes the mounting detecting section 110 to detect the presence/absence of the medium P mounted on the medium-mounting section 31. Upon detecting the medium P being mounted on the medium-mounting section 31, the control section 100 starts a feeding operation. That is, the control section 100 causes the output shaft 130*a* of the second motor 130 to rotate in reverse (reverse rotation) (timing T1) to switch the respective restricting members 61 and 62 from the restriction posture to the retreat posture.

The power of the second motor 130 is thereby transferred to the restricting drive shaft 54 via the third power transferring unit 150. As a result, the restricting drive shaft 54 rotates, and the protruding section 57 and the light-shielding member 71 rotate accordingly. The protruding section 57 then separates from the pressed section 60. The urging force of the rotating spring 53 rotates the restricting rotational shaft 52. As a result, the respective restricting members 61 and 62 rotate from the position at which the restriction posture is taken to the position at which the retreat posture is taken. That is, the respective restricting members 61 and 62 are inclined in the transport direction so as to take the posture along the transport guide 32. Note that, when the respective restricting members 61 and 62 move to the position at which the retreat posture is taken, the light-shielding member 71 moves to a position different from the position between the light-emitting section 72*a* and the light-receiving section 72*b*, and a signal of the rotation detecting unit 70 is in the off state (timing T2).

As a result, the control section 100 determines that the respective restricting members 61 and 62 are in the retreat posture in accordance with the detection result from the rotation detecting unit 70.

When determining that the respective restricting members 61 and 62 are in the retreat posture, the control section 100 decelerates the second motor 130. At this time, the control section 100 performs an operation of rotating the feeding roller 43 and an operation of switching the respective restricting members 61 and 62 from the restriction posture to the retreat posture in parallel. That is, while decelerating the second motor 130, the control section 100 causes the output shaft 120*a* of the first motor 120 to rotate forward (forward rotation) and causes the feeding roller 43 to start to rotate (timing T3). That is, the feeding roller 43 starts to rotate before the respective restricting members 61 and 62 take the retreat posture. Note that "before the respective restricting members 61 and 62 take the retreat posture" is before a time point (timing T4) at which reverse rotation of the second motor 130 is stopped.

Note that a timing of starting rotation of the feeding roller 43 is not limited as long as the timing is within a period from when the medium P mounted on the medium-mounting section 31 is detected until reverse rotation of the output shaft 130*a* of the second motor 130 is stopped. For example, the control section 100 may control the feeding roller 43 to start to rotate before causing the output shaft 130*a* of the second motor 130 to rotate in reverse and before causing the respective restricting members 61 and 62 to move from the restriction position to the retreat position.

When the respective restricting members 61 and 62 shift from the restriction posture to the retreat posture, the tip end 61*b* of the first restricting member 61 separates from the feeding unit 40. That is, the feeding unit 40 terminates the contact state against the first restricting member 61 and shifts from the separation posture to the contact posture. When the feeding unit 40 takes the contact posture, the feeding roller 43 comes into contact with the medium P. The medium P is thereby fed by the feeding roller 43 in the transport direction.

When reverse rotation of the output shaft 130*a* of the second motor 130 is stopped, the control section 100 causes the output shaft 130*a* of the second motor 130 to rotate forward (timing T5). The fed medium P is thereby transported by the pair of transport rollers 81 in the transport direction. An image of the transported medium P is read by the reading device 21. The medium P whose image has been read is discharged to the discharge section 36.

Note that, when the mounting detecting section 110 and the first medium-detecting section 113 determine that no medium P is on the medium-mounting section 31, the control section 100 stops forward rotation of the output shaft 120*a* of the first motor 120.

Figure 15:
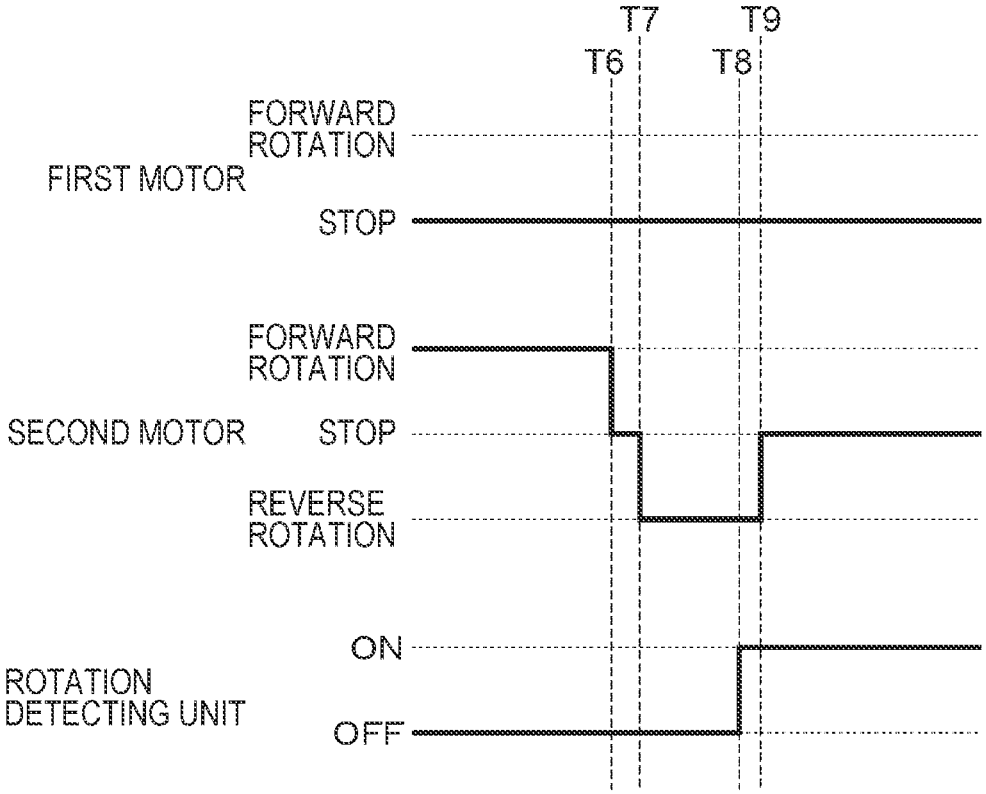
FIG. 15 is a timing chart illustrating operation timings in discharge control.

Next, operation after medium discharge will be described with reference to the drawings described above and the timing chart of FIG. 15.

The control section 100 causes the second medium-detecting section 114 to determine whether the medium P on the transport path 300 is discharged. When determining that the medium P is discharged, the control section 100 stops the second motor 130 that rotates forward (timing T6). After the second motor 130 is stopped, the control section 100 causes the output shaft 130*a* of the second motor 130 to rotate in reverse (timing T7). The power of the second motor 130 is thereby transferred to the restricting drive shaft 54 via the third power transferring unit 150. As a result, the restricting drive shaft 54 rotates, and the protruding section 57 and the light-shielding member 71 rotate accordingly. The protruding section 57 then comes into contact with the pressed section 60, and the restricting rotational shaft 52 rotates against a force from the rotating spring 53. As a result, the respective restricting members 61 and 62 shift from the retreat posture to the restriction posture. When the respective restricting members 61 and 62 move to the position at which the restriction posture is taken, the light-shielding member 71 moves to a position between the light-emitting section 72*a* and the light-receiving section 72*b*, and a signal of the rotation detecting unit 70 is in the on state (timing T8). The control section 100 thereby determines that the respective restricting members 61 and 62 are in the restriction posture in accordance with the detection result from the rotation detecting unit 70. The control section 100 then decelerates and stops reverse rotation of the output shaft 130*a* of the second motor 130 (timing T9).

2. Second Embodiment

A second embodiment will be described. The same configurations as those of the first embodiment will be given the same reference numerals, and redundant description will be omitted.

In the present embodiment, the control section 100 changes the timing of rotating the feeding roller 43 in accordance with a thickness of the medium P.

When the mounting detecting section 110 detects that the medium P is mounted on the medium-mounting section 31, the control section 100 causes the touch panel 16 to display a setting screen on which the user selects a thickness of the mounted medium P. The setting screen displays three types of setting buttons of thick paper, plain paper, and thin paper indicating a thickness of the medium P to encourage the user to select a thickness of the medium P. The control section 100 determines the thickness of the mounted medium P in accordance with information of the selected setting button. Note that the number of types of the thickness of the medium P that is able to be selected is not limited to three and may be two or four or more.

The control section 100 changes the timing of starting rotation of the feeding roller 43, which corresponds to the timing T3 in the first embodiment, in accordance with the determined thickness of the medium P. In a case in which the fed medium P is thin paper, due to low rigidity of thin paper, when the leading end of the fed thin paper excessively comes into contact with the respective restricting members 61 and 62, the leading end of the thin paper may be folded. Thus, in the case of thin paper, the medium P is desirably fed after the respective restricting members 61 and 62 move to the position at which they do not come into contact with the leading end of the thin paper.

On the other hand, in a case in which the fed medium P is thick paper, due to high rigidity of thick paper, even when the fed thick paper comes into contact with the respective restricting members 61 and 62, there is no possibility of the thick paper being folded. Moreover, in the case of thick paper, when the leading end of the thick paper comes into contact with the respective restricting members 61 and 62 during feeding, it is possible to correct skewing of the thick paper. That is, in the case of thick paper, the leading end of the thick paper may come into contact with the respective restricting members 61 and 62 during feeding before the respective restricting members 61 and 62 finish shifting to the retreat posture. Thus, in the case of thick paper, the timing of starting rotation of the feeding roller 43 is desirably earlier than in the case of thin paper.

Moreover, in the case of thick paper, the timing of starting rotation of the feeding roller 43 may be earlier than in the case of plain paper. Further, in the case of thin paper, the timing of starting rotation of the feeding roller 43 may be later than in the case of plain paper. As a result, it is possible to feed the medium P appropriately. Further, in the case of thin paper, it is possible to further reduce a possibility of a leading end of paper being folded compared with the case of plain paper.

On the setting screen for setting a thickness of the medium P, it is also possible to select a paper type and set the thickness of the medium P in accordance with the selected paper type. For example, a post card, glossy paper, and a business form are able to be selected as a paper type, and thick paper may be set when a post card or glossy paper is selected, and thin paper may be set when a business form is selected. By selecting a paper type as described, the user is able to set a thickness of the medium P appropriately even when the user does not know the thickness of the medium P.

As a method of setting a thickness of the medium P, a basis weight may be set. In this case, a basis weight of the medium P, which is set in advance, may be selected on the setting screen, or a basis weight of the medium P may be input. By performing processing in this manner, a thickness of the medium P is able to be determined in accordance with the basis weight.

The medium P may be specified in accordance with a combination of the thickness, paper type, and basis weight of the medium P. This makes it possible to specify the medium P to be fed in more detail, resulting in appropriate feeding of the medium P.

Note that, only in the case of thick paper, the control section 100 may perform the operation of rotating the feeding roller 43 and the operation of switching the respective restricting members 61 and 62 from the restriction posture to the retreat posture in parallel. Moreover, only in the case of thin paper, the control section 100 may perform the operation of rotating the feeding roller 43 after switching the respective restricting members 61 and 62 from the restriction posture to the retreat posture. In such cases, the medium P is able to be fed appropriately in accordance with the thickness of the medium P.

3. Third Embodiment

A third embodiment will be described. The same configurations as those of the first embodiment will be given the same reference numerals, and redundant description will be omitted.

In the present embodiment, the control section 100 changes the timing of rotating the feeding roller 43, which corresponds to the timing T3 in the first embodiment, in accordance with a total thickness of the medium P mounted on the medium-mounting section 31. Note that, when a single medium P is mounted on the medium-mounting section 31, the total thickness of the medium P indicates a thickness of the medium P, and when a plurality of media P are mounted on the medium-mounting section 31, the total thickness of the medium P indicates a thickness of all the plurality of media P, that is, a thickness of a document bundle.

Figure 16:
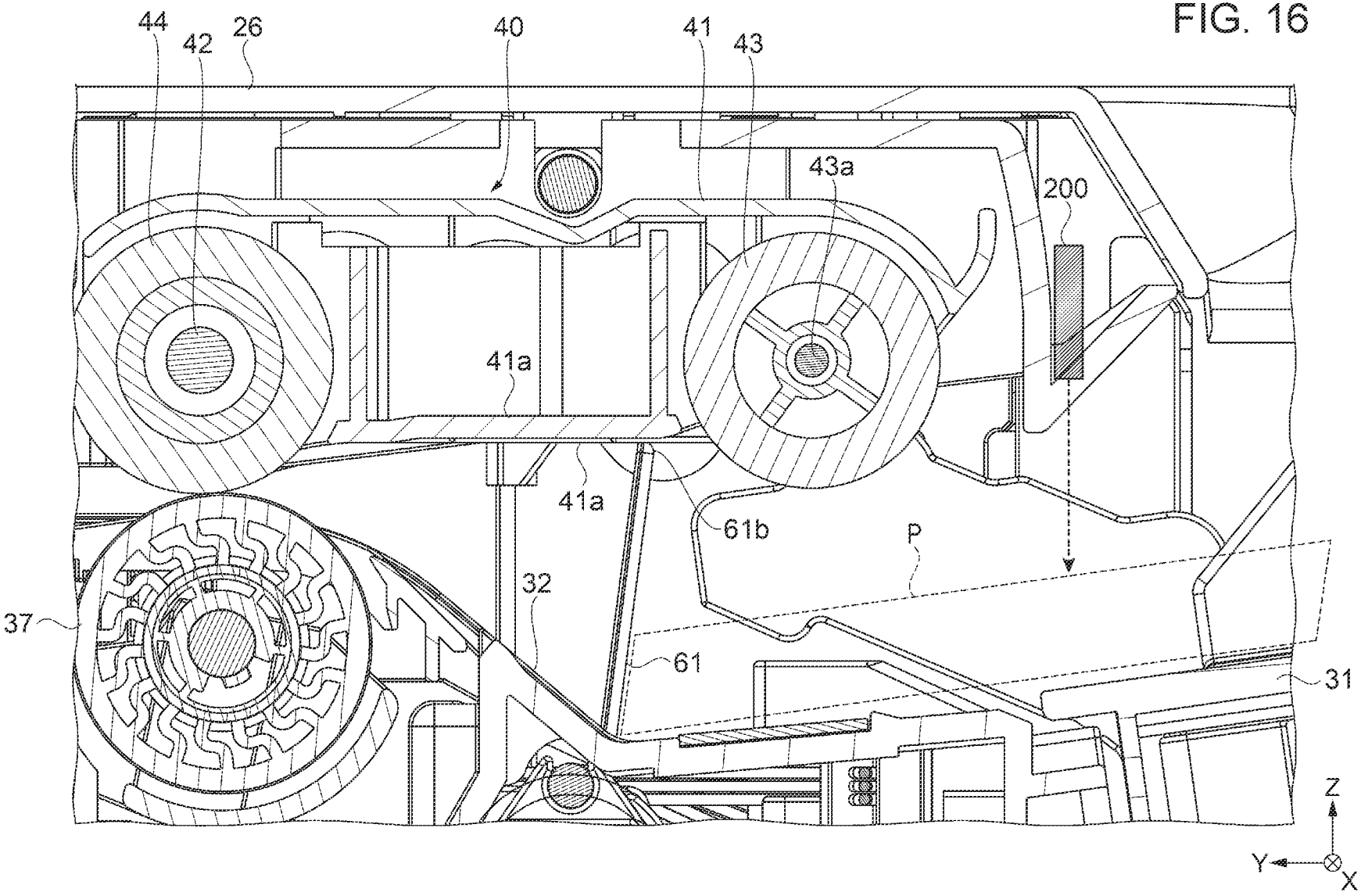
FIG. 16 is a sectional view illustrating a portion of an image reading apparatus of a third embodiment in an enlarged manner.

As illustrated in FIG. 16, the medium-transporting device 30 of the present embodiment includes a ranging sensor 200 as a total-thickness detecting section for detecting a total thickness. The ranging sensor 200 is an ultrasonic sensor provided in the upper unit 26 at a position facing the medium P mounted on the medium-mounting section 31. The ranging sensor 200 includes a transmitting section and a receiving section, which are not illustrated, transmits ultrasonic waves to the uppermost medium P, and receives, by using the receiving section, reflected waves reflected by the uppermost medium P to thereby detect a distance between the ranging sensor 200 and the uppermost medium P. Note that the ranging sensor 200 may use another system and may be an optical sensor.

The control section 100 determines the total thickness of the medium P mounted on the medium-mounting section 31 in accordance with the detection result from the ranging sensor 200. The control section 100 then adjusts the timing of starting rotation of the feeding roller 43 in accordance with the total thickness of the medium P. That is, when the total thickness of the medium P is equal to or more than a first threshold, the timing of starting rotation of the feeding roller 43 is made earlier than in a case in which the total thickness is less than the first threshold. Moreover, when the total thickness of the medium P is less than a second threshold smaller than the first threshold, the timing of starting rotation of the feeding roller 43 is made later than in a case in which the total thickness is equal to or more than the second threshold.

The first threshold indicates, for example, a dimension corresponding to three-fourths the dimension of the first restricting member 61, which is in the restriction posture and extends from the transport guide 32, in the +Z direction. When the total thickness of the medium P is equal to or more than the first threshold, the leading end of the uppermost medium P mounted on the medium-mounting section 31 is at a position close to the tip end 61*b* of the first restricting member 61. In this case, the respective restricting members 61 and 62 release restriction on the leading end of the uppermost medium P during feeding earlier than in the case in which the total thickness is less than the first threshold. Thus, when the total thickness is equal to or more than the first threshold, there is no possibility of the leading end of the uppermost medium P being folded due to excessive contact with the respective restricting members 61 and 62. Accordingly, when the total thickness of the medium P is equal to or more than the first threshold, the timing of starting rotation of the feeding roller 43 is desirably earlier than in the case in which the total thickness is less than the first threshold. As a result, when the total thickness of the medium P is equal to or more than the first threshold, feeding time is able to be shortened compared with the case in which the total thickness is less than the first threshold.

The second threshold has a value smaller than the first threshold and indicates, for example, a dimension corresponding to one-fourth the dimension of the first restricting member 61, which is in the restriction posture and extends from the transport guide 32, in the +Z direction. When the total thickness of the medium P is less than the second threshold, the leading end of the uppermost medium P mounted on the medium-mounting section 31 is at a position close to the base end 61*a* of the first restricting member 61. In this case, when the timing of the feeding roller 43 feeding the medium P is early, the leading end of the medium P to be fed may be folded due to excessive contact with the respective restricting members 61 and 62 that have not finished shifting to the retreat posture. Thus, when the total thickness of the medium P is less than the second threshold, the timing of starting rotation of the feeding roller 43 is desirably later than in the case in which the total thickness is equal to or more than the second threshold. As a result, it is possible to feed the medium P appropriately.

Note that the first threshold or the second threshold may be used alone, or they may be used in combination.

The first threshold and the second threshold described above are examples and may be set to any values.

Note that, only in a case in which the first threshold is set, the control section 100 may perform the operation of rotating the feeding roller 43 and the operation of switching the respective restricting members 61 and 62 from the restriction posture to the retreat posture in parallel. Moreover, in a case in which the second threshold is set, the control section 100 may perform the operation of rotating the feeding roller 43 after switching the respective restricting members 61 and 62 from the restriction posture to the retreat posture. In such cases, the medium P is able to be fed appropriately in accordance with the thickness of the medium P.

Next, operational effects of the above-described embodiments will be described.

(1) The medium-transporting device 30 includes the first motor 120 that is configured to generate power for rotating the feeding roller 43 and the second motor 130 that is configured to generate power for switching the postures of the respective restricting members 61 and 62 of the restricting unit 50. When the medium P mounted on the medium-mounting section 31 is fed, the operation of rotating the feeding roller 43 and the operation of switching the respective restricting members 61 and 62 from the restriction posture to the retreat posture are performed in parallel.

In this manner, the feeding roller 43 is driven by a motor separate from a motor for driving the respective restricting members 61 and 62, and the operation of rotating the feeding roller 43 and the operation of switching the respective restricting members 61 and 62 from the restriction posture to the retreat posture are performed in parallel, thus making it possible to quickly perform the operation of feeding the medium P. That is, it is possible to enhance FCOT.

(2) The second motor 130 is able to generate power for rotating the respective drive rollers 81*a*, 82*a*, 83*a*, and 84*a*.

Accordingly, since the second motor 130 that generates a power source for driving the respective restricting members 61 and 62 drives the respective drive rollers 81*a*, 82*a*, 83*a*, and 84*a*, it is not necessary to provide an additional motor.

As a result, a space for installing a motor is not necessary compared with a configuration in which an additional motor is provided, thus making it possible to reduce an apparatus size.

(3) When the respective restricting members 61 and 62 shift from the retreat posture to the restriction posture, the unit partition surface 41*a* comes into contact with the tip end 61*b* of the first restricting member 61, and the feeding unit 40 thus shifts from the contact posture in which the feeding unit 40 comes into contact with the medium P mounted on the medium-mounting section 31 to the separation posture in which the feeding unit 40 separates from the medium P.

Since the operation of the first restricting member 61 switches the feeding unit 40 between the contact posture and the separation posture, it is not necessary to provide a dedicated power source for switching the posture of the feeding unit 40.

(4) The feeding roller 43 starts to rotate before the respective restricting members 61 and 62 switch from the restriction posture to the retreat posture.

When the feeding roller 43 starts to rotate before the respective restricting members 61 and 62 switch from the restriction posture to the retreat posture, the feeding roller 43 is able to feed the medium P more quickly.

Moreover, while the feeding unit 40 is in the separation posture, the feeding roller 43 is at a position not in contact with the medium P. Thus, there is no possibility of an occurrence of jamming even when the feeding roller 43 starts to rotate while being in the separation posture. That is, it is possible to feed the medium P more quickly without a possibility of an occurrence of jamming.

(5) In the medium-transporting device 30, the third power transferring unit 150 for transferring power of the second motor 130 to the restricting drive shaft 54 includes the one-way clutch 153. When the second motor 130 rotates forward, the respective drive rollers 81*a*, 82*a*, 83*a*, and 84*a* rotate in the direction in which the medium P is transported downstream. On the other hand, the one-way clutch 153 does not transfer the power of the second motor 130 to the restricting drive shaft 54. Thus, when the second motor 130 rotates forward, the respective restricting members 61 and 62 do not change their postures.

Accordingly, since no power is transferred to the restricting drive shaft 54 while the respective pairs of transport rollers 81, 82, 83, and 84 transport the medium P, it is possible to reduce a load on the second motor 130.

(6) The medium-transporting device 30 includes the operation section 15 capable of displaying a setting screen for setting a thickness of the mounted medium P. The user inputs information about a thickness of the medium P to the setting screen. The control section 100 determines the thickness of the medium P in accordance with the input information and adjusts the timing of starting rotation of the feeding roller 43 in accordance with the thickness of the medium P.

As a result, even thin paper which is likely to be folded when coming into contact with the respective restricting members 61 and 62 is able to be fed appropriately. Moreover, in the case of thick paper with high rigidity, even when the leading end of the thick paper comes into contact with the respective restricting members 61 and 62 during feeding, there is no possibility of the thick paper being folded. When the leading end of the thick paper comes into contact with the respective restricting members 61 and 62, it is possible to correct skewing.

(7) The medium-transporting device 30 includes the ranging sensor 200 that is provided in the medium-mounting section 31 and that detects a total thickness of the mounted medium P. The control section 100 determines a total thickness of the medium P in accordance with the detection result from the ranging sensor 200. Further, the control section 100 adjusts the timing of starting rotation of the feeding roller 43 in accordance with the total thickness of the medium P.

When the total thickness of the medium P is great, the respective restricting members 61 and 62 release restriction on the leading end of the uppermost medium P much earlier during feeding. Thus, in a case in which the total thickness of the medium P is great, even when the medium P is fed by moving the feeding roller 43 quickly, there is no possibility of the leading end of the medium P being folded due to excessive contact with the respective restricting members 61 and 62, thus making it possible to feed the medium P appropriately.

When the total thickness of the medium P is small, the leading end of the fed medium P may be folded due to excessive contact with the respective restricting members 61 and 62 that have not finished shifting to the retreat posture during feeding. Thus, in a case in which the total thickness of the medium P is small, when the timing of starting rotation of the feeding roller 43 is made later, it is possible to feed the medium P without the tip end of the medium P being folded.

4. Fourth Embodiment

A medium-transporting device according to a fourth embodiment will be described. The medium-transporting device of the present embodiment includes a restricting unit 50A instead of the restricting unit 50 described above. In the following description, the same configurations as those of the first embodiment will be given the same reference numerals, and detailed description thereof will be omitted.

Figure 17:
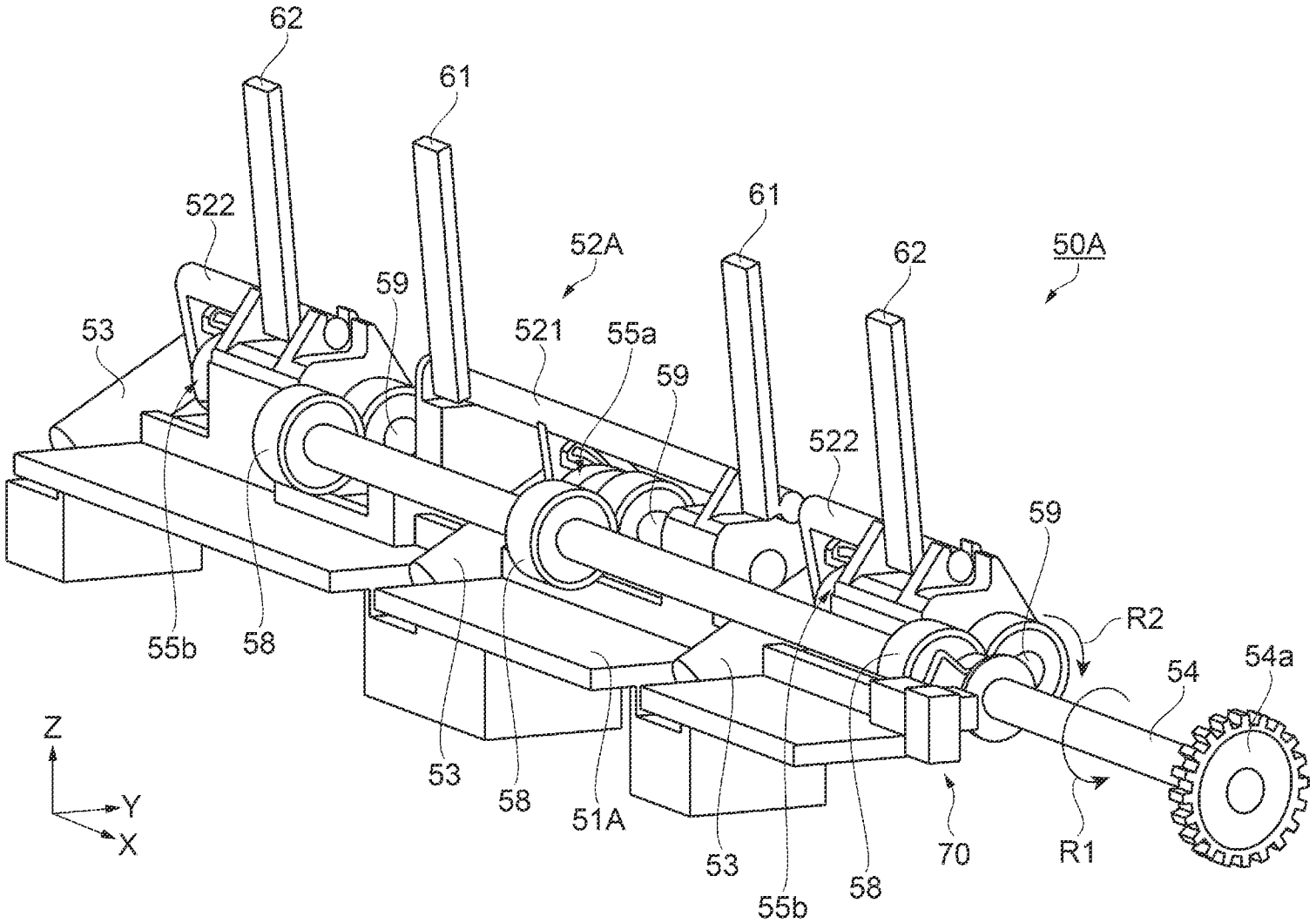
FIG. 17 is a perspective view illustrating a restricting unit according to a fourth embodiment.
Figure 18:
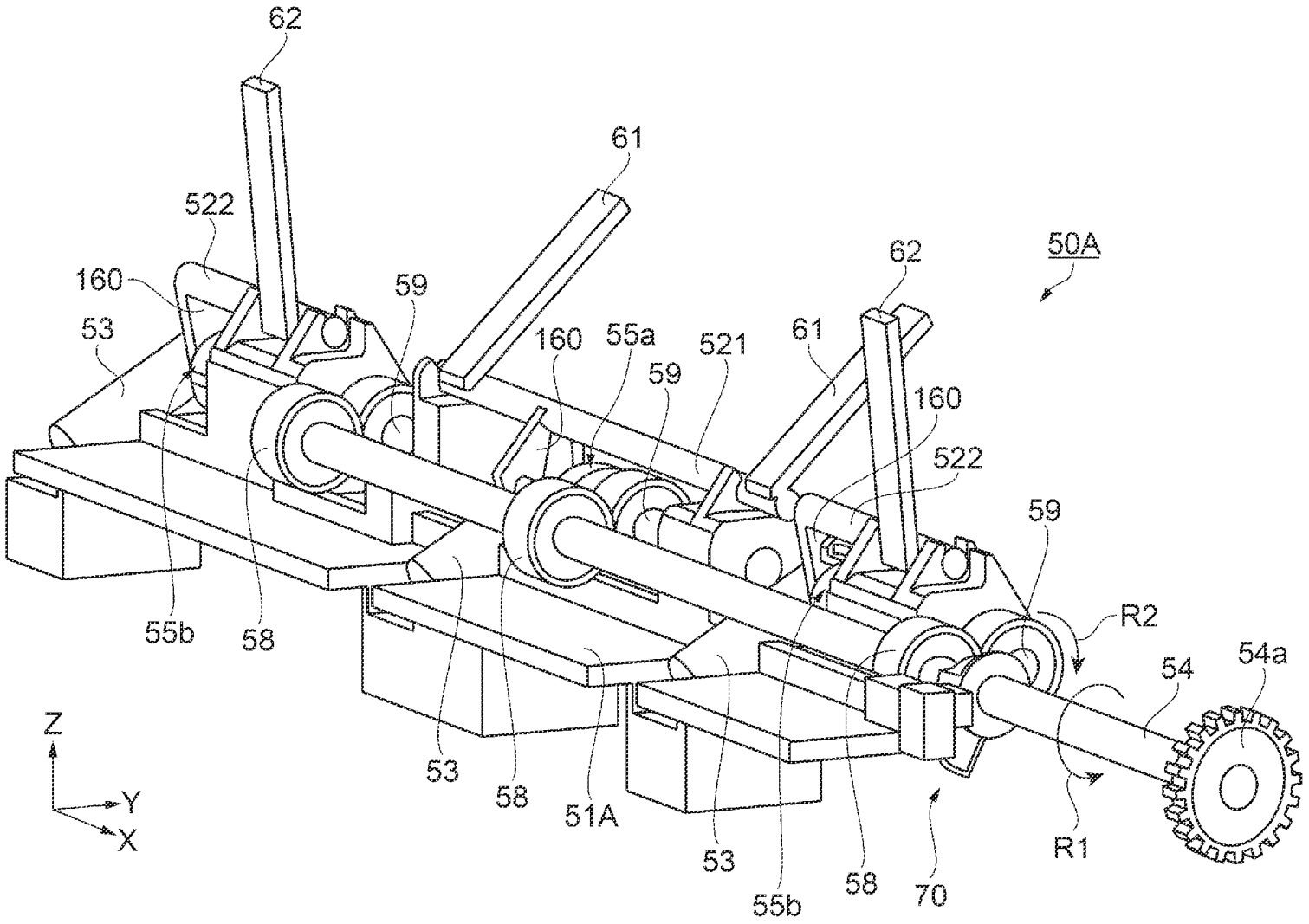
FIG. 18 is a perspective view illustrating the restricting unit according to the fourth embodiment.
Figure 19:
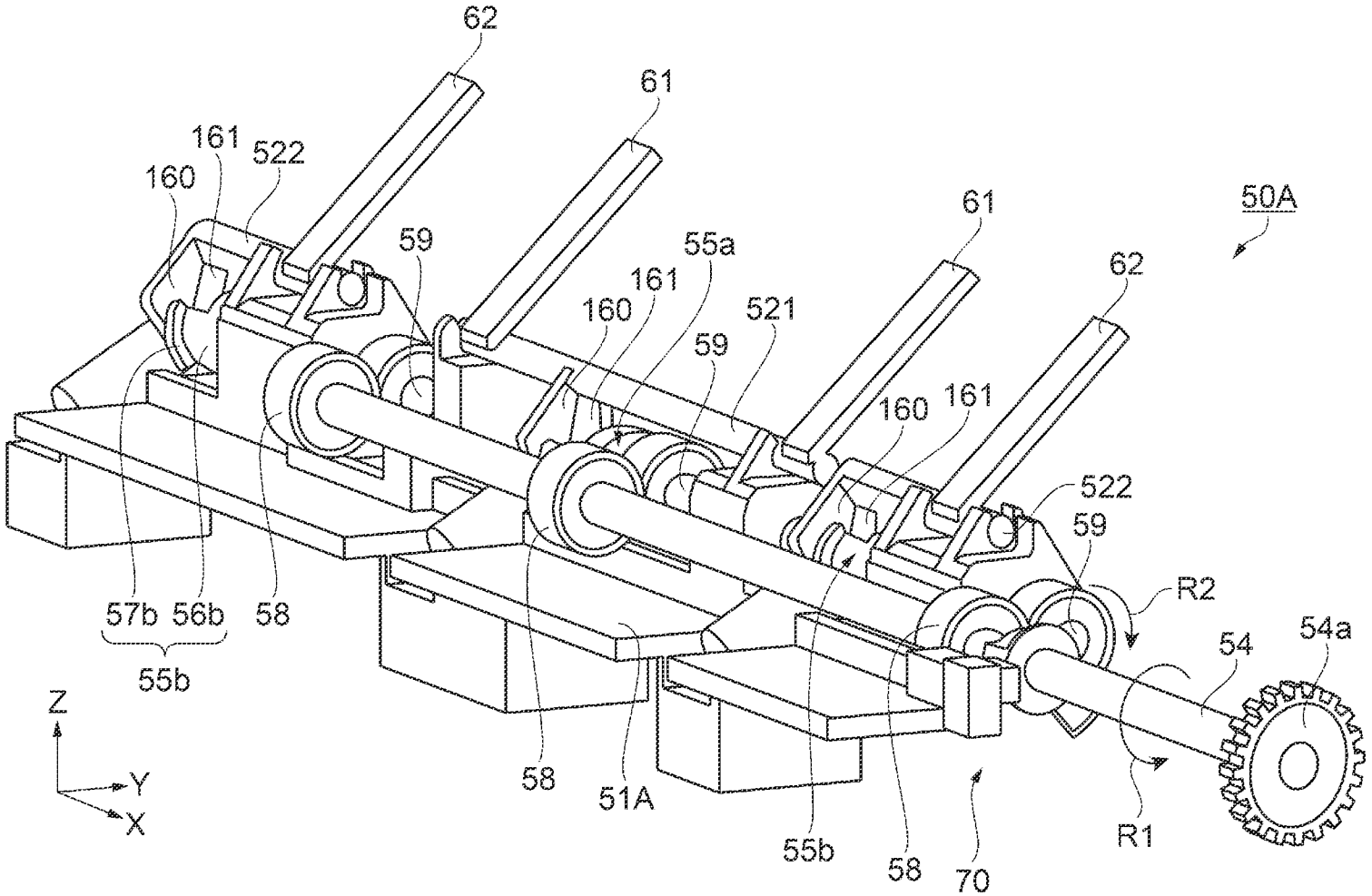
FIG. 19 is a perspective view illustrating the restricting unit according to the fourth embodiment.

The restricting unit 50A of the present embodiment will be described. FIG. 17 is a perspective view illustrating the restricting unit 50A in which the first restricting member 61 and the second restricting member 62 are in the restriction posture, FIG. 18 is a perspective view illustrating the restricting unit 50A in which the first restricting member 61 is in the retreat posture and the second restricting member 62 is in the restriction posture, and FIG. 19 is a perspective view illustrating the restricting unit 50A in which the first restricting member 61 and the second restricting member 62 are in the retreat posture. The first restricting member 61 and the second restricting member 62 of the restricting unit 50A may shift from the restriction posture to the retreat posture at different timings.

As illustrated in FIGS. 17 to 19, the restricting unit 50A includes a restricting unit main body 51A, a restricting rotational shaft 52A, and three rotating springs 53.

The restricting unit main body 51A supports the restricting rotational shaft 52A and the restricting drive shaft 54 in a rotatable state and is fixed to the medium-transporting device so as to extend in the X direction at an opposite side of the transport guide 32 from the upstream transport path 310 similarly to the restricting unit main body 51 of FIG. 4.

Upon receiving the power of the second motor 130 (not illustrated in FIGS. 17 to 19) via the third power transferring unit 150, the restricting drive shaft 54 rotates in the predetermined rotational direction R1. One end of the restricting drive shaft 54 in the +X direction is positioned outside the restricting unit main body 51A, and the other end of the restricting drive shaft 54 in the −X direction is positioned inside the restricting unit main body 51A.

The rotation detecting unit 70 for detecting rotation of the restricting drive shaft 54 and three rotation transferring sections 58 for transferring rotation of the restricting drive shaft 54 are provided between one end and the other end of the restricting drive shaft 54.

The rotation detecting unit 70 detects the rotational state of the restricting drive shaft 54 by detecting whether to be the light-shielding state in which light of the detecting section 72 is not able to be received by being blocked by the light-shielding member 71 or the light-receiving state in which light of the detecting section 72 is able to be received.

The rotation transferring section 58 is constituted by a plurality of interlocking rotational bodies. The rotational bodies of the present embodiment are, for example, paired gears. One of the gears has a disc-shaped central axis portion into which the restricting drive shaft 54 is inserted so as to be coupled in an integrally rotatable state. Moreover, the other gear interlocking with the aforementioned gear has a disc-shaped central axis portion into which a cam shaft 59 is inserted so as to be coupled in an integrally rotatable state. The three rotation transferring sections 58 are arranged with any gap therebetween in the X direction. Rotation of the restricting drive shaft 54 in the rotational direction R1 is transferred by the three rotation transferring sections 58 to rotate three cam shafts 59 in the rotational direction R2.

Each of the three cam shafts 59 is inserted into a corresponding one of a single rotation restricting section 55*a* and two rotation restricting sections 55*b* so as to be coupled in an integrally rotatable state. The cam shafts 59 rotate in the rotational direction R2 while being supported by the restricting unit main body 51A and thus enable the rotation restricting sections 55*a* and 55*b* to rotate in the rotational direction R2.

Figure 20:
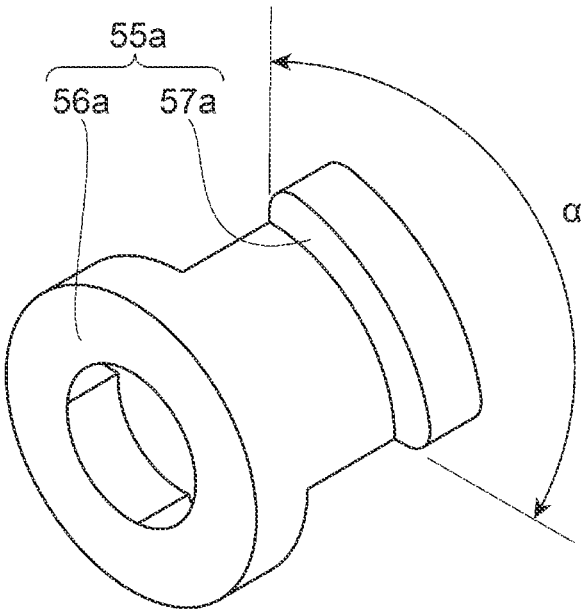
FIG. 20 is a perspective view illustrating a rotation restricting section.

Configurations of the rotation restricting sections 55*a* and 55*b* will be described by taking the rotation restricting section 55*a* as an example. As illustrated in FIG. 20, the rotation restricting section 55*a* includes a cam 56*a* and a protruding section 57*a*. The cam 56*a* has a cylinder shape and is coupled to the cam shaft 59 while the cam shaft 59 is inserted into a hole section provided in the center of a circle portion. Moreover, a portion of a side surface of the cylinder shape extends in the extending direction and has a tip end in which the protruding section 57*a* of a flange shape is formed. Each of the rotation restricting sections 55*b* includes a cam 56*b* of a cylinder shape and a protruding section 57*b* of a flange shape similarly to the rotation restricting section 55*a*.

A difference between the rotation restricting section 55*a* and the rotation restricting section 55*b* lies in lengths of circular arcs of the protruding section 57*a* and the protruding section 57*b*. The tip end of the protruding section 57*a* and the tip end of the protruding section 57*b* in the rotational direction R2 are provided to be at the same positions when viewed in the X direction parallel to the axial directions of a first restricting rotational shaft 521 and a second restricting rotational shaft 522. On the other hand, the rear end of the protruding section 57*a* and the rear end of the protruding section 57*b* in the rotational direction R2 are provided to be at different positions when viewed in the X direction. That is, the rear end of the protruding section 57*b* is positioned to extend farther than the rear end of the protruding section 57*a* in the direction opposite to the rotational direction R2 when viewed in the X direction.

In the present embodiment, for example, the protruding section 57*a* is formed in a range in which center angle $\alpha$ is 90°, and the protruding section 57*b* is formed in a range in which center angle $\alpha$ is 120°. That is, in the present embodiment, the rear end of the protruding section 57*b* is positioned to extend farther than the rear end of the protruding section 57*a* by a rotational angle 30° in the direction opposite to the rotational direction R2 when viewed in the X direction.

Since the rotation restricting sections 55*a* and 55*b* in the present embodiment rotate synchronously, the aforementioned positional relationship of the protruding section 57*a* and the protruding section 57*b* does not change.

Note that the protruding sections 57*a* and 57*b* may change their lengths or positions of the circular arcs appropriately. By changing the lengths or positions, it is possible to adjust time during which the first restricting member 61 and the second restricting member 62 are kept in the restriction posture or the retreat posture and the timing of the first restricting member 61 and the second restricting member 62 shifting their postures.

As illustrated in FIGS. 17 to 19, the restricting rotational shaft 52A includes one first restricting rotational shaft 521 and two second restricting rotational shafts 522. The restricting rotational shaft 52A is provided such that the one first restricting rotational shaft 521 is positioned between the two second restricting rotational shafts 522 so as to extend in the X direction. The first restricting rotational shaft 521 and the second restricting rotational shafts 522 are coaxial rotational shafts extending in the X direction and are separately rotatable about the X axis.

The restricting rotational shaft 52A includes the first restricting members 61 and the second restricting members 62, each of which corresponds to a restricting member. The first restricting member 61 is coupled to each end of the first restricting rotational shaft 521 in the extending direction in an integrally rotatable state. The second restricting member 62 is coupled to the second restricting rotational shaft 522 in an integrally rotatable state. The first restricting member 61 and the second restricting member 62 are plate-like members extending from the restricting rotational shaft 52A in one direction.

The two first restricting members 61 are positioned to be symmetrical with respect to the center point in the width direction intersecting the transport direction parallel to the Y direction. Further, the second restricting members 62 are provided on the outer sides of the two first restricting members 61 with respect to the center point. In other words, the second restricting members 62 are provided such that a distance between the center point in the width direction and the second restricting member 62 is longer than a distance between the center point in the width direction and the first restricting member 61.

Moreover, the two first restricting members 61 are able to come into contact with the unit partition surface 41*a*, which corresponds to the contact section of the feeding unit 40 (not illustrated in FIGS. 17 to 19), and when the two first restricting members 61 shift from the retreat posture to the restriction posture, the unit partition surface 41*a* comes into contact with the two first restricting members 61, and the feeding unit 40 thus takes the separation posture.

The one first restricting rotational shaft 521 and the two second restricting rotational shafts 522 each includes a support section 160. The support section 160 is a plate-like member of a substantially triangle shape, and a vertex portion thereof in the +Z direction is coupled to the restricting rotational shaft 52A in an integrally rotatable state. Moreover, the support section 160 includes a pressed section 161 of a wall shape along one side of the surface facing the rotation restricting sections 55*a* or 55*b*.

The pressed section 161 faces the protruding section 57*a* or the protruding section 57*b* and comes into contact with or separates from the protruding section 57*a* or the protruding section 57*b* upon rotation of the rotation restricting section 55*a* or 55*b*. The support section 160 includes a support portion for supporting one end of the rotating spring 53, and a restoring force from the rotating spring 53 acts on the support section 160 via the support portion.

One end of each of the three rotating springs 53 is attached to the restricting unit main body 51A, and the other end thereof is attached to the support section 160 of the first restricting rotational shaft 521 or the second restricting rotational shaft 522. Thus, the rotating spring 53 urges the restricting rotational shaft 52A in the direction in which the restricting rotational shaft 52A rotates. The rotation of the restricting rotational shaft 52A enables the first restricting members 61 and the second restricting members 62 to shift their postures.

Figure 21:
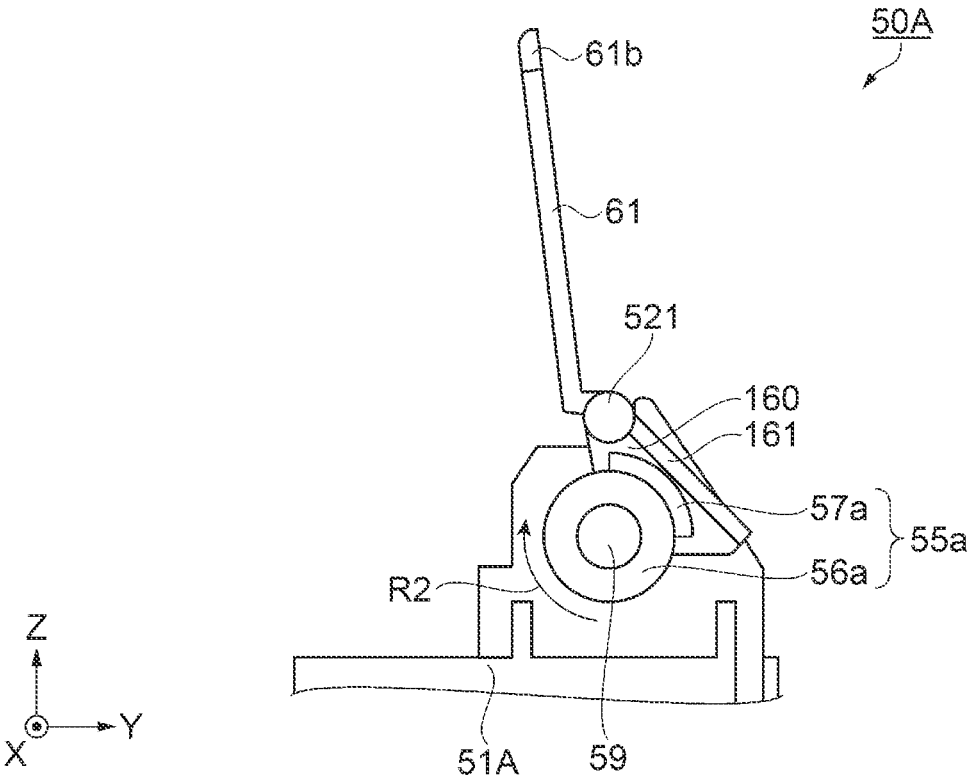
FIG. 21 is a side view illustrating a restriction posture of a first restricting member.
Figure 22:
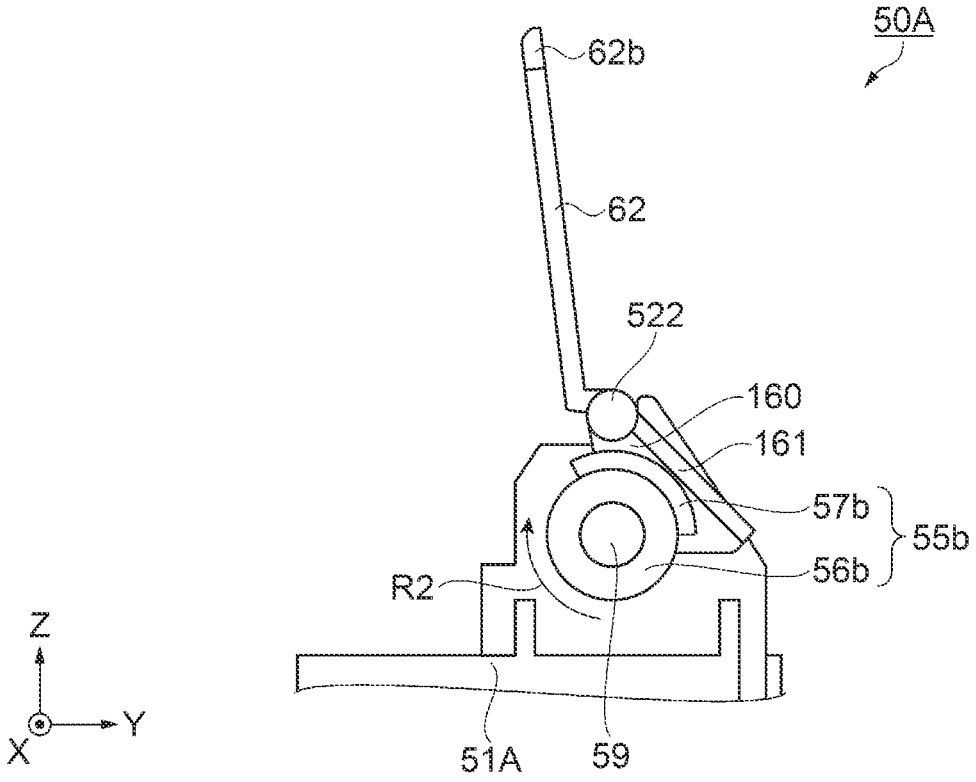
FIG. 22 is a side view illustrating a restriction posture of a second restricting member.

The restriction posture of each of the first restricting member 61 and the second restricting member 62 of the restricting unit 50A will be described. As illustrated in FIG. 21, when the protruding section 57*a* of the rotation restricting section 55*a* presses the pressed section 161 in a contact manner, rotation of the first restricting rotational shaft 521 is restricted, and the first restricting member 61 takes the restriction posture. Moreover, as illustrated in FIG. 22, when the protruding section 57*b* of the rotation restricting section 55*b* presses the pressed section 161 in a contact manner, rotation of the second restricting rotational shaft 522 is restricted, and the second restricting member 62 takes the restriction posture.

Figure 23:
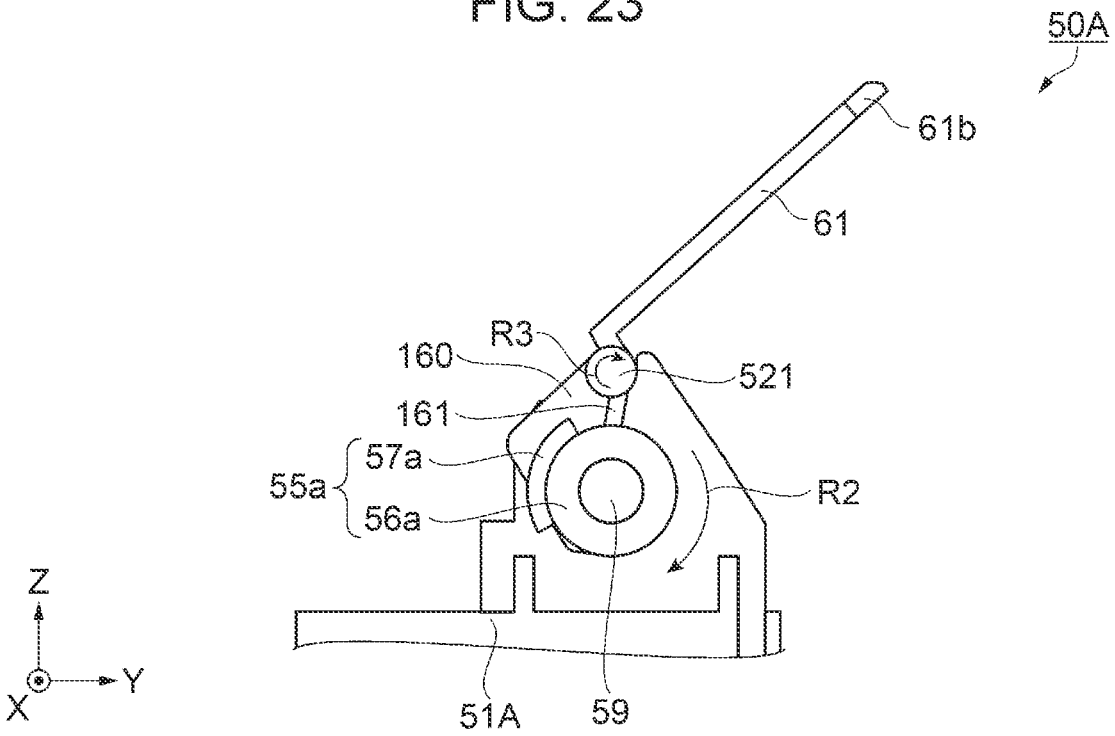
FIG. 23 is a side view illustrating a retreat posture of the first restricting member.

Regarding the first restricting member 61, when the cam shaft 59 rotates in the rotational direction R2 and when the protruding section 57*a* of the rotation restricting section 55*a* thereby rotates in the rotational direction R2 as illustrated in FIG. 23, the protruding section 57*a* separates from the pressed section 161. The urging force from the rotating spring 53 rotates the first restricting rotational shaft 521 in a rotational direction R3, and the first restricting member 61 shifts from the restriction posture to the retreat posture. Since the circular arc of the protruding section 57*b* of the second restricting member 62 has a circumference longer than that of the circular arc of the protruding section 57*a*, when the cam shaft 59 further rotates in the rotational direction R2, the protruding section 57*b* separates from the pressed section 161, and the second restricting member 62 shifts from the restriction posture to the retreat posture. In the present embodiment, when the cam shaft 59 further rotates by 30° after the protruding section 57*a* separates from the pressed section 161, the protruding section 57*b* separates from the pressed section 161.

Figure 24:
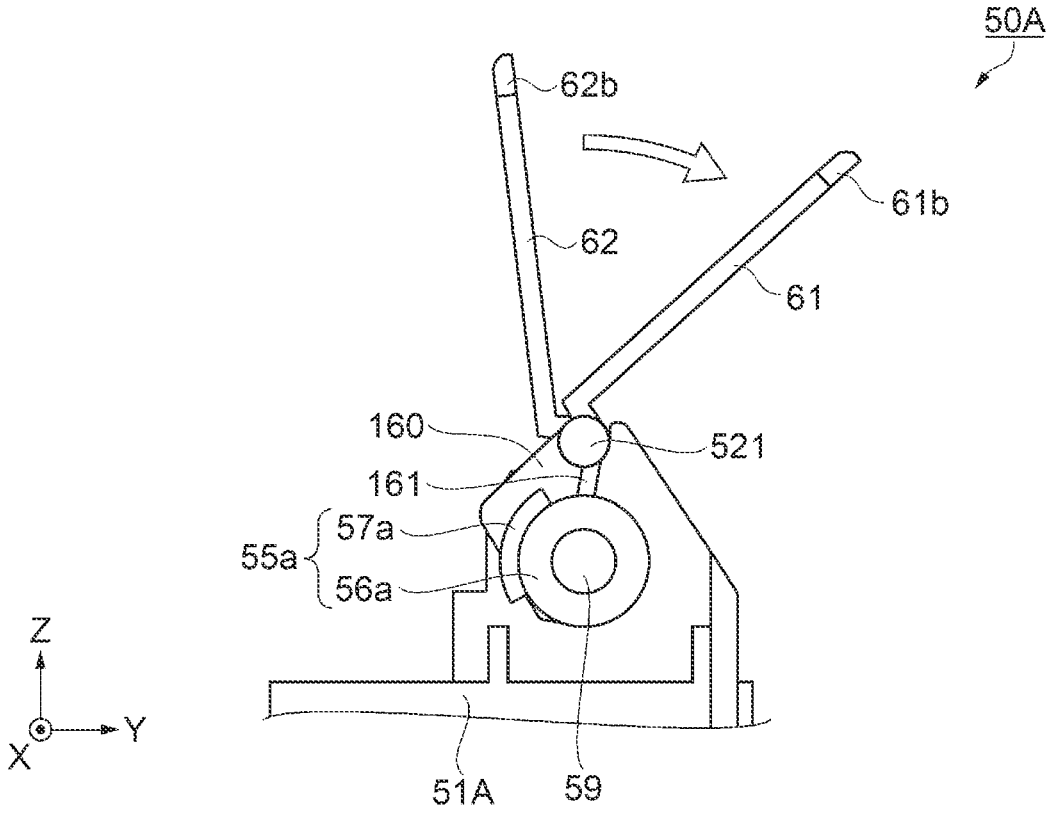
FIG. 24 is a side view illustrating a state in which the second restricting member shifts to the retreat posture.

Note that the first restricting member 61 and the second restricting member 62 are displaced at different phases. Thus, when the second restricting member 62 shifts from the restriction posture to the retreat posture, the first restricting member 61 has already shifted to the retreat posture. Accordingly, in the side view of the rotation restricting section 55*a* when viewed in the X direction, which is illustrated in FIG. 24, the surface of the first restricting member 61, which is in contact with the medium P, does not overlap the surface of the second restricting member 62, which is in contact with the medium P.

The restricting unit 50A of the present embodiment includes the first restricting rotational shaft 521 and the second restricting rotational shaft 522, which are independent from each other, and the rotation restricting sections 55*a* and 55*b*, and is thus able to shift the first restricting member 61 and the second restricting member 62 to the retreat posture at different timings.

Figure 25:
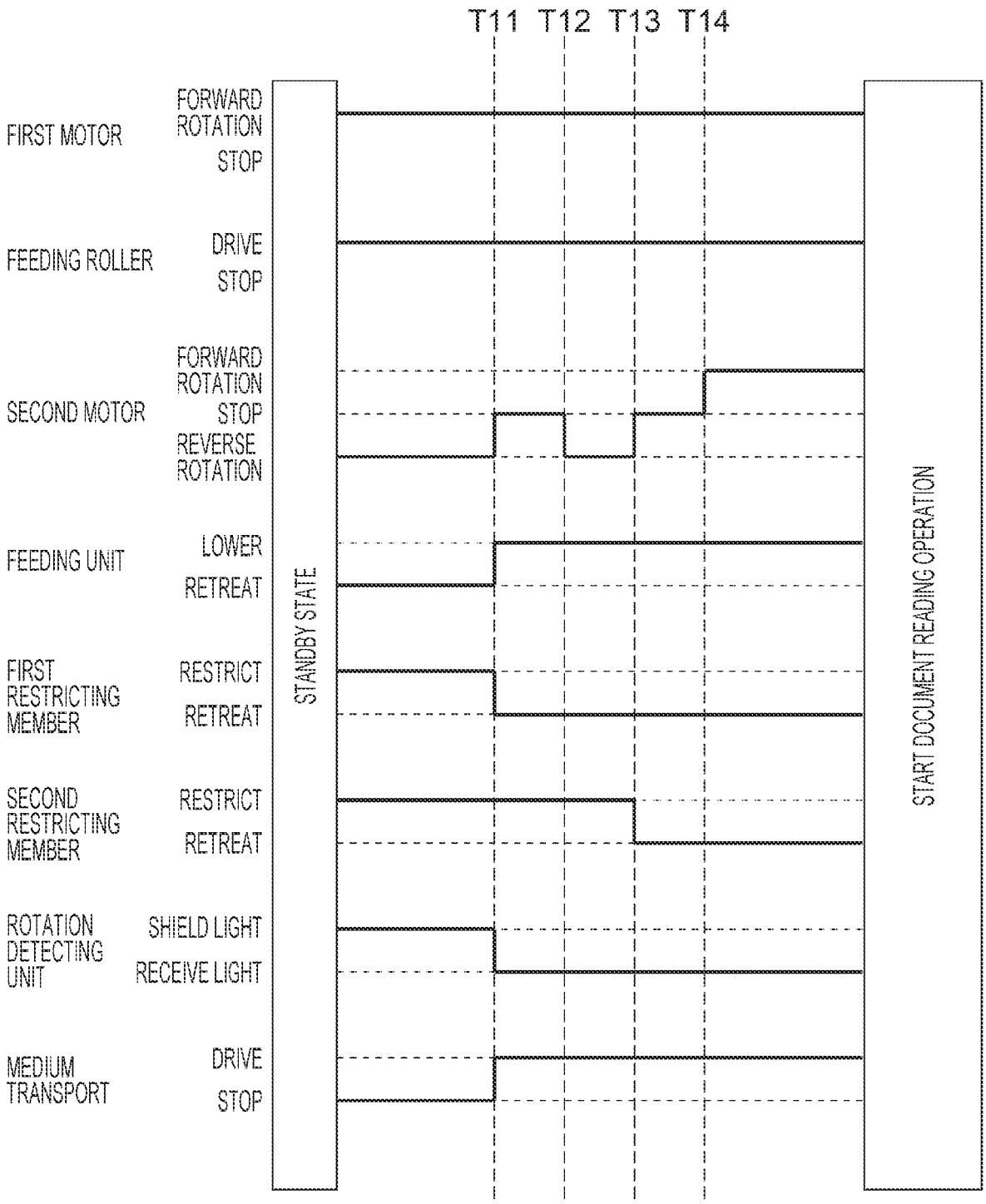
FIG. 25 is a timing chart illustrating operation timings in feeding control.
Figure 26:
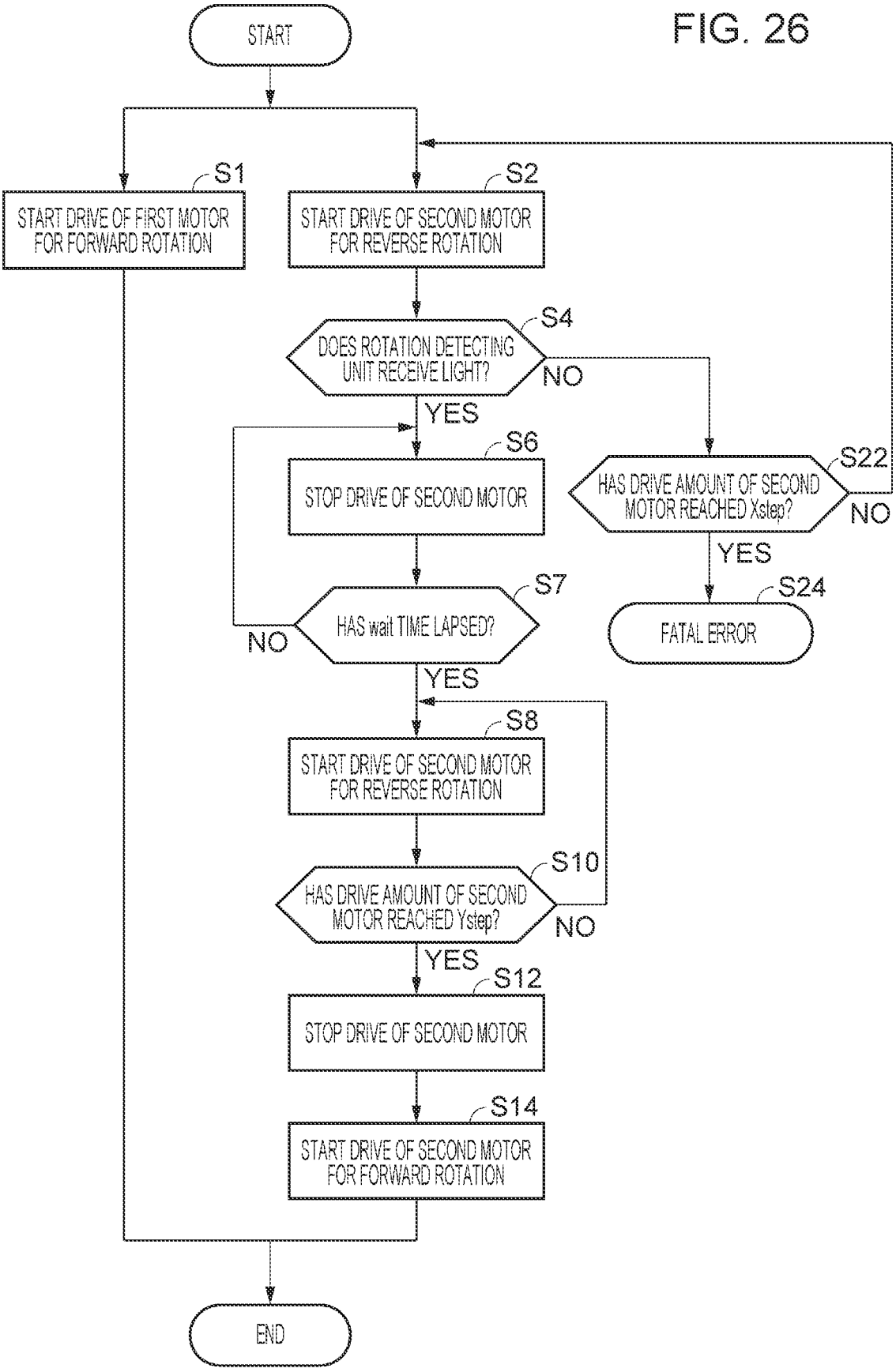
FIG. 26 is a flowchart of feeding control.
Figure 27:
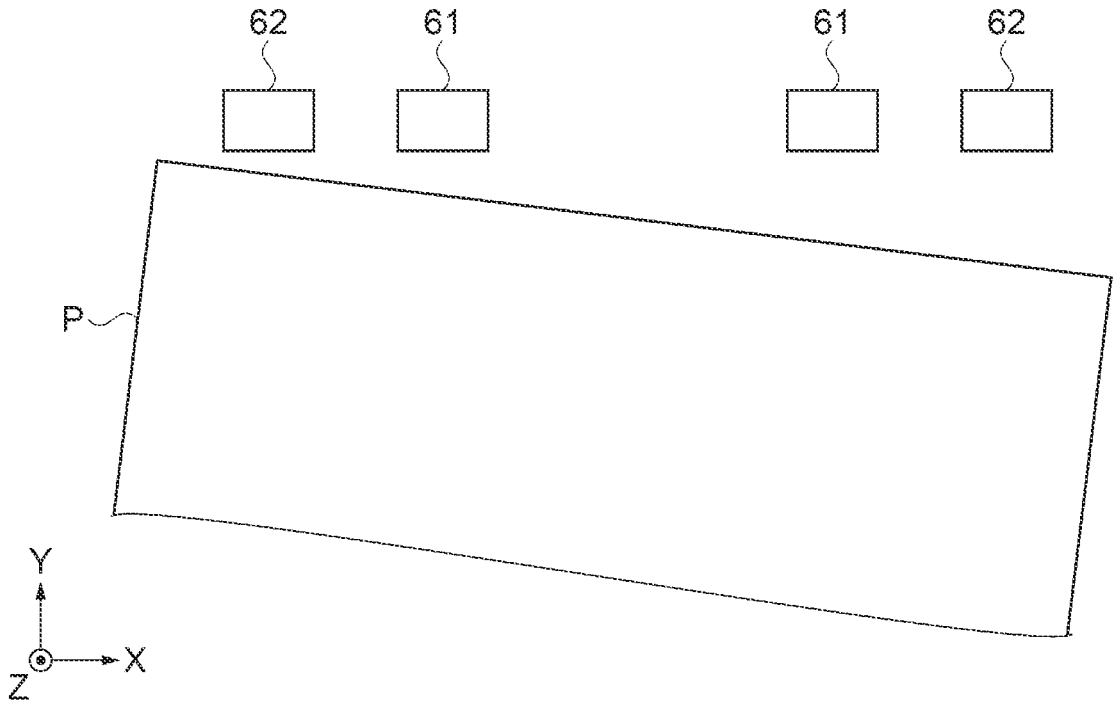
FIG. 27 is a schematic top view illustrating a state in which a medium is mounted on a medium-mounting section in an inclined manner.
Figure 28:
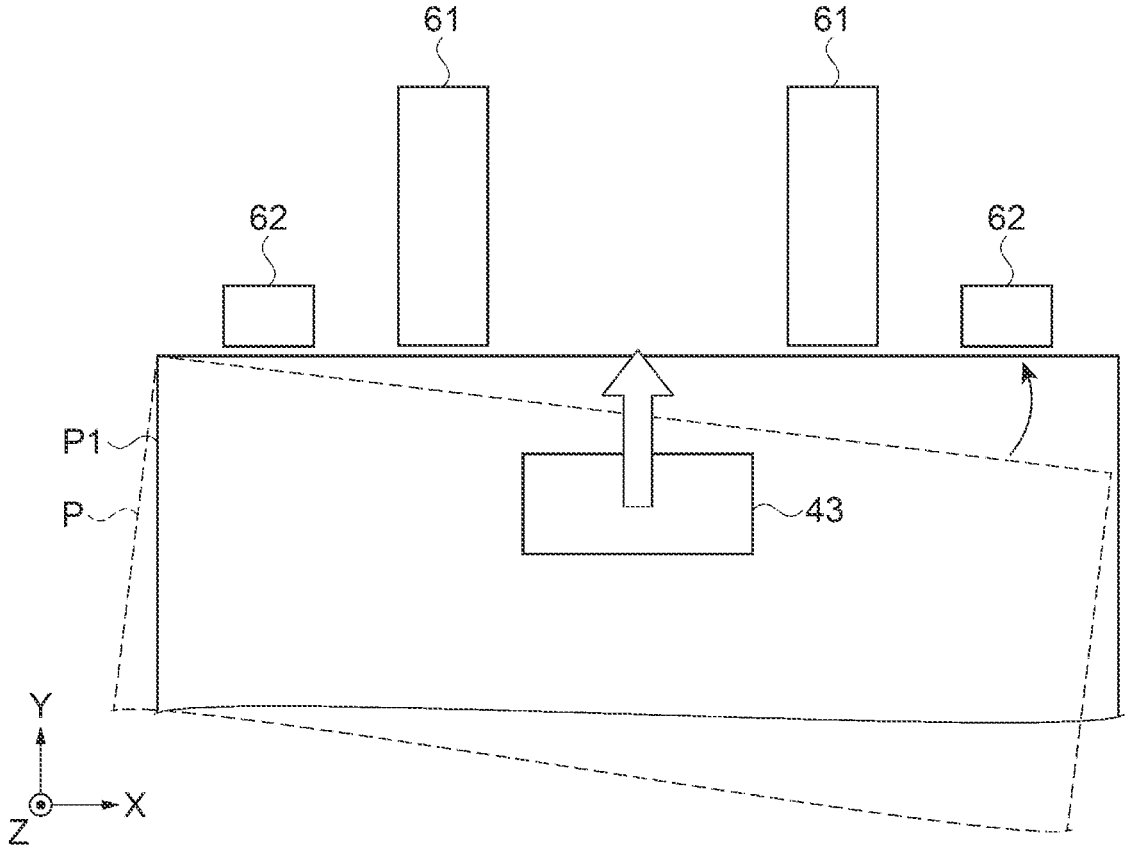
FIG. 28 is a schematic top view illustrating a state in which skewing of the medium on the medium-mounting section is corrected.
Figure 29:
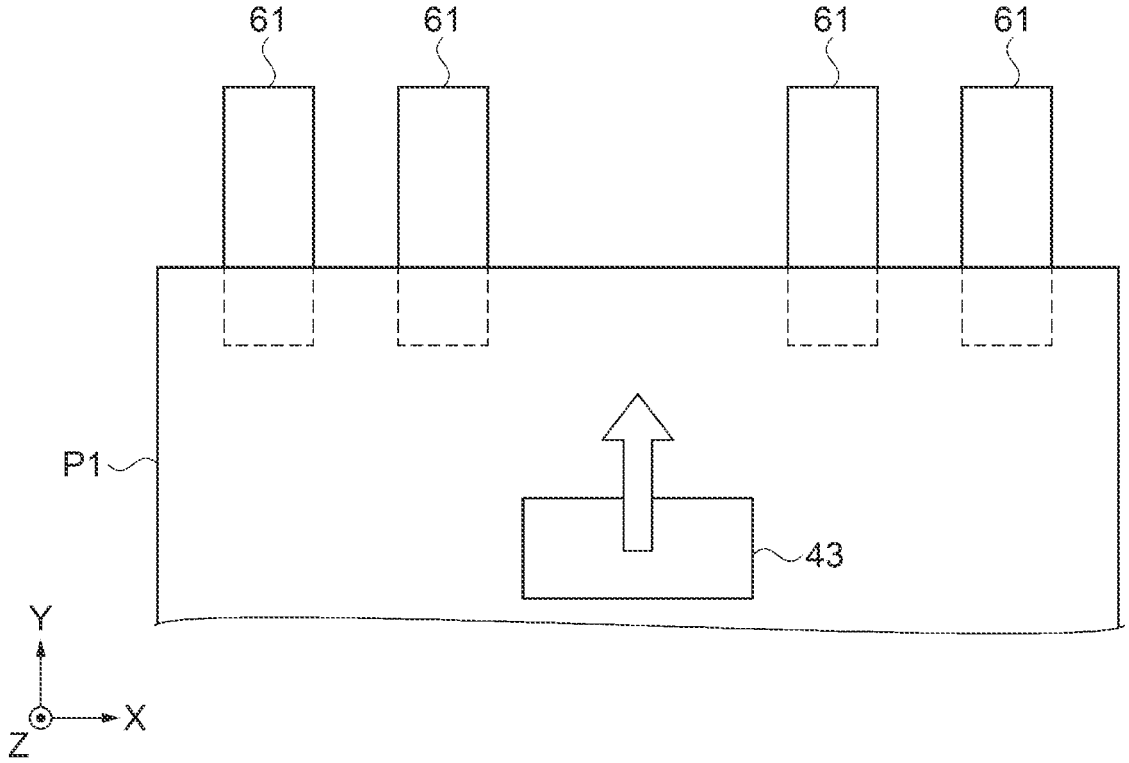
FIG. 29 is a schematic top view illustrating a state in which the medium on the medium-mounting section is transported.

Next, feeding control of the medium P in the present embodiment will be described with reference to FIGS. 25 to 29 besides the drawings described above. FIG. 25 is a timing chart illustrating operation timings during feeding control of the medium-transporting device, and FIG. 26 is a flowchart of power control when the medium P is fed. FIGS. 27 to 29 are schematic top views each illustrating a state in which the medium P mounted on the medium-mounting section is transported while skewing is corrected.

First, in feeding control of the present embodiment, when it is detected that the medium P is mounted on the medium-mounting section 31, the feeding operation starts from a standby state.

In step S1, the first motor 120 starts to be driven for forward rotation, and the feeding roller 43 starts to be driven. In parallel to step S1, the second motor 130 starts to be driven for reverse rotation in step S2.

Next, in step S4, whether the rotation detecting unit 70 detects light reception is determined. When the rotation detecting unit 70 detects light reception (YES), the drive of the second motor 130 is stopped as indicated in step S6. Simultaneously, the protruding section 57*a* of the rotation restricting section 55*a* which rotates synchronously with the restricting drive shaft 54 separates from the pressed section 161, the first restricting member 61 thus shifts to the retreat posture, and the feeding unit 40 is lowered. Accordingly, transport of the medium P starts to be driven (timing T11 in FIG. 25).

In step S6, even in a case in which the medium P is mounted on the medium-mounting section 31 in an inclined manner as illustrated in FIG. 27, when the feeding roller 43 provided in the feeding unit 40 that is lowered is driven, the medium P moves in the direction of outlined arrow as illustrated in FIG. 28. At this time, an edge of the skewed medium P, which arrives earlier, abuts the second restricting member 62. On the other hand, an edge of the medium P, which arrives later, is transported to the second restricting member 62 while rotating. As a result, the skewing of the medium P is corrected, and inclination is corrected as in a medium P1.

When the rotation detecting unit 70 does not detect light reception in step S4 (NO), whether or not the drive amount of the second motor 130 has reached Xstep is determined in step S22. Xstep indicates the drive amount of the second motor 130 and corresponds to a drive amount calculated by adding a drive amount obtained by considering manufacturing tolerance and variation in assembly to a drive amount required to switch the first restricting member 61 from the restriction posture to the retreat posture.

When the drive amount of the second motor 130 has not reached Xstep (NO), the procedure returns to step S2, and when the drive amount of the second motor 130 has reached Xstep (YES), a predetermined error notification is performed as fatal error in step S24.

After the drive of the second motor 130 is stopped in step S6, the procedure proceeds to step S7 in which whether or not a predetermined wait time has lapsed is determined. When the predetermined wait time has lapsed, the procedure proceeds to step S8. When the predetermined wait time has not lapsed, step S6 is repeated to keep the drive of the second motor 130 in the stopped state.

In step S8, the second motor 130 starts to be driven for reverse rotation (timing T12 in FIG. 25). By providing the predetermined wait time until the drive restarts in step S8 after the drive is stopped in step S6, it is possible to adjust the abutting amount of the medium P. For example, when the wait time in step S6 is extended, it is possible to increase the amount by which the medium P abuts the second restricting member 62 upon driving the feeding roller 43 and enhance the effect of correcting skewing of the medium P. On the other hand, when the wait time in step S6 is shortened, it is also possible to reduce the amount by which the medium P abuts the second restricting member 62 upon driving the feeding roller 43.

Note that it is also possible to reduce the abutting amount when the procedure proceeds directly from step S4 to the operation of step S10 by skipping steps S6 to S8.

Next, in step S10, whether or not the drive amount of the second motor 130 has reached Ystep is determined. Ystep corresponds to a drive amount of the second motor 130 required to switch the second restricting member 62 to the retreat posture after step S4. In other words, Ystep corresponds to a drive amount calculated by adding a drive amount obtained by considering manufacturing tolerance and variation in assembly to the drive amount of the second motor 130, which indicates a rotational amount corresponding to a phase shift between the rotation restricting sections 55*a* and 55*b*.

When the drive amount of the second motor 130 has not reached Ystep in step S10 (NO), step S10 is repeated, and when the drive amount of the second motor 130 has reached Ystep (YES), the drive of the second motor 130 is stopped in step S12.

In step S12, the drive of the second motor 130 is stopped. At the same time, the second restricting member 62 shifts to the retreat posture (timing T13 in FIG. 25).

When the first restricting member 61 and the second restricting member 62 take the retreat posture, the medium P1 is transported in the +Y direction, which is the transport direction.

Next, in step S14, the second motor 130 starts to be driven for forward rotation. Upon forward rotation of the second motor 130, the pair of transport rollers 81 is driven, and the transported medium P1 is transported downstream in the transport direction on the transport path 300.

Next, operation after medium discharge will be described.

The control section 100 causes the second medium-detecting section 114 to determine whether the medium P on the transport path 300 is discharged. When determining that the medium P is discharged, the control section 100 stops the second motor 130 that rotates forward. After the second motor 130 is stopped, the control section 100 causes the second motor 130 to rotate in reverse. The respective restricting members 61 and 62 thereby shift from the retreat posture to the restriction posture.

In the present embodiment, the tip end of the protruding section 57*a* and the tip end of the protruding section 57*b* in the rotational direction R2 are provided to be at the same positions when viewed in the X direction. Accordingly, the respective restricting members 61 and 62 shift from the retreat posture to the restriction posture simultaneously.

Note that the timing at which the control section 100 causes the first motor 120 to rotate forward to drive the feeding roller 43 is able to be appropriately changed as long as the timing is in a period until the second restricting member 62 switches from the restriction posture to the retreat posture after the medium P mounted on the medium-mounting section 31 is detected. For example, the control section 100 may cause the first motor 120 to rotate forward when the second motor 130 starts to be driven for reverse rotation in step S8.

Note that the amount by which the medium P abuts the second restricting member 62 may be changed in accordance with a paper type or thickness of the medium. A paper type or thickness of the medium may be set by using the method described in the second embodiment or the third embodiment.

5. Fifth Embodiment

A medium-transporting device according to a fifth embodiment will be described. The medium-transporting device of the present embodiment differs from that of the fourth embodiment in arrangement of the first restricting member 61.

Figure 30:
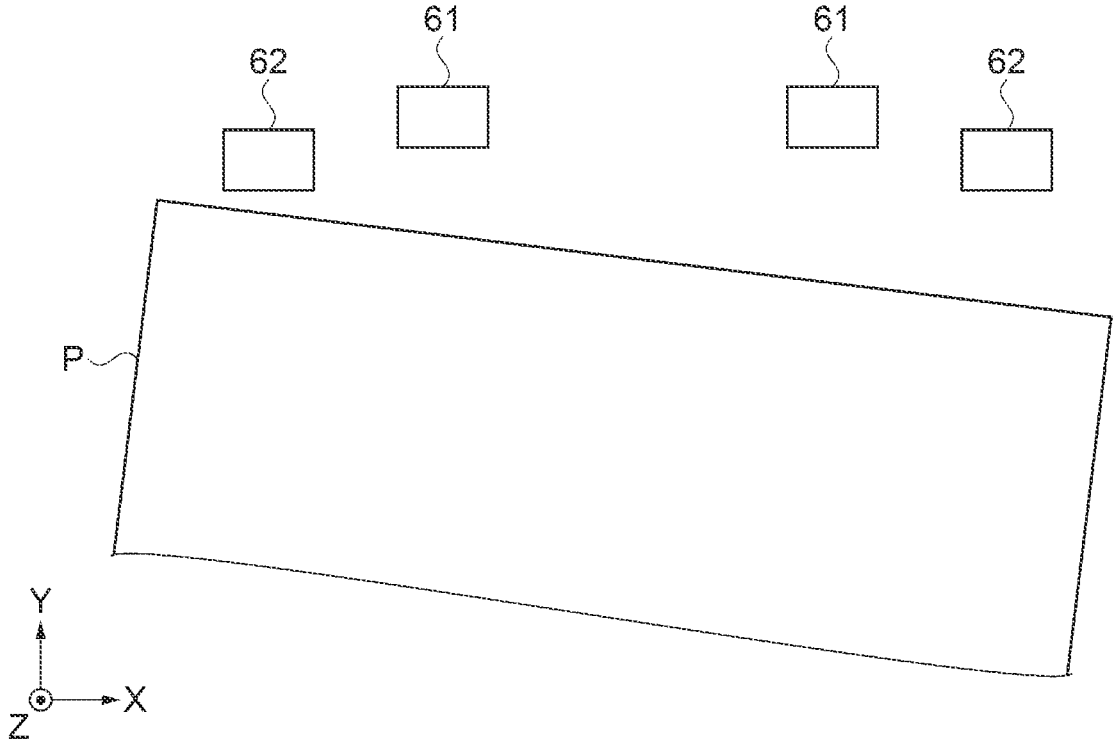
FIG. 30 is a schematic top view illustrating arrangement of restricting members according to a fifth embodiment.

FIG. 30 illustrates a state in which the medium P is mounted on the medium-mounting section in an inclined manner and is a schematic top view illustrating arrangement of the first restricting member 61 and the second restricting member 62 which are in the restriction posture.

The first restricting member 61 and the second restricting member 62 are arranged in the X direction in the fourth embodiment, whereas the first restricting member 61 is positioned downstream of the second restricting member 62 in the transport direction in the present embodiment.

Note that the rotation transferring section 58 in the fourth embodiment is constituted by a pair of gears, whereas the rotation transferring section in the present embodiment is constituted by a plurality of rotational bodies (not illustrated) such that the first restricting rotational shaft 521 and the second restricting rotational shaft 522 rotate in an interlocking manner. When the rotation transferring section includes the plurality of rotational bodies, the first restricting member 61 is able to be positioned downstream of the second restricting member 62. Note that the rotation transferring section may be another power transferring member or a belt.

Next, operational effects of the above-described fourth and fifth embodiments will be described.

(8) According to the configuration of the medium-transporting device in the fourth embodiment, since the second restricting member 62 switches from the restriction posture to the retreat posture at a timing after the first restricting member 61 switches its posture, when the leading end of the fed medium P comes into contact with the second restricting member 62, skewing is able to be corrected. Thus, even when the medium P is fed in an inclined manner, jamming hardly occurs on the transport path. In particular, even in a case in which the medium P has an A4 or letter size whose width is long, when skewing is corrected, problematic transport is less likely to occur.

(9) According to the configuration of the medium-transporting device of the fifth embodiment, since the first restricting members 61 close to the center point in the width direction intersecting the transport direction are positioned downstream of the second restricting members 62, which are positioned on the outer sides of the respective first restricting members 61, in the transport direction, it is possible to suppress the medium P from being skewed due to the leading end of the medium P coming into contact with the first restricting member 61.

(10) According to the configuration of the medium-transporting device of each of the above-described fourth and fifth embodiments, since the feeding unit 40 shifts its posture upon changing the posture of the first restricting member 61, even the configuration in which the first restricting member 61 and the second restricting member 62 change their postures at different timings enables the feeding unit 40 to switch its posture appropriately.

(11) An image reading apparatus including the medium-transporting device of the above-described embodiments exerts operational effects similar to those of the above-described medium-transporting device.

Needless to say, the disclosure is not limited to the embodiments described above, various modifications can be made within the scope of the disclosure described in the claims, and these modifications are also included within the scope of the disclosure. Moreover, the above-described embodiments may be combined appropriately. The image reading apparatus 20 is configured to be provided in the multi-functional peripheral 1 in the above-described embodiments but is applicable to another scanner.

The first restricting member 61 and the second restricting member 62 have a plate shape in the above-described embodiments but are not limited to having such a shape as long as they have a surface for abutting the medium P.

The feeding unit 40 switches its posture upon changing the posture of the first restricting member 61 in the above-described embodiments, but there is no limitation thereto. The feeding unit 40 is also able to include a power source for switching the posture.

In the aforementioned embodiments, the protruding section 57*a* and the protruding section 57*b* differ from each other in length of the circular arc such that the first restricting member 61 and the second restricting member 62 are displaced at different phases, but there is no limitation thereto. When the cam 56*a* and the cam 56*b* differ from each other in diameter such that the first restricting member 61 and the second restricting member 62 are displaced at different phases, it is possible to adjust time during which the restriction posture or the retreat posture is kept, and time and timing of shifting the posture.

What is claimed is:

1. A medium-transporting device comprising:

a medium-mounting section on which a medium is mounted;

a feeding unit that includes a feeding roller for feeding the medium mounted on the medium-mounting section in a transport direction and that is configured to be displaced between a contact posture in which the feeding roller comes into contact with the medium mounted on the medium-mounting section and a separation posture in which the feeding roller separates from the medium;

a restricting member that is provided downstream of the feeding roller in the transport direction and that is configured to switch between a restriction posture in which the restricting member restricts movement of the medium and a retreat posture in which the restricting member permits the movement of the medium;

a first motor configured to generate power for rotating the feeding roller;

a second motor configured to generate power for switching a posture of the restricting member; and a transport roller that is provided downstream of the feeding unit in the transport direction and that transports the medium, wherein an operation of rotating the feeding roller and an operation of switching the restricting member from the restriction posture to the retreat posture are performed in parallel, and the second motor is configured to generate power for rotating the transport roller.

2. The medium-transporting device according to claim 1, wherein the feeding unit includes a contact section configured to come into contact with the restricting member, and when the restricting member shifts from the retreat posture to the restriction posture and comes into contact with the contact section, the feeding unit takes the separation posture.

3. The medium-transporting device according to claim 1, wherein the feeding roller starts to rotate before the restricting member switches from the restriction posture to the retreat posture.

4. The medium-transporting device according to claim 1, further comprising an operation section configured to display a setting screen for setting a thickness of the medium which is mounted on the medium-mounting section, wherein the thickness of the medium is determined in accordance with information input through the setting screen, and a timing of starting rotation of the feeding roller is adjusted in accordance with the thickness of the medium.

5. The medium-transporting device according to claim 1, further comprising a total-thickness detecting section that detects a total thickness of the medium which is mounted on the medium-mounting section, wherein the total thickness of the medium is determined in accordance with a detection result from the total-thickness detecting section, and a timing of starting rotation of the feeding roller is adjusted in accordance with the total thickness of the medium.

6. An image reading apparatus comprising:

the medium-transporting device according to claim 1; and a reading section configured to read an image of the medium which is transported.

7. A medium-transporting device comprising:

a medium-mounting section on which a medium is mounted;

a feeding unit that includes a feeding roller for feeding the medium mounted on the medium-mounting section in a transport direction and that is configured to be displaced between a contact posture in which the feeding roller comes into contact with the medium mounted on the medium-mounting section and a separation posture in which the feeding roller separates from the medium;

a restricting member that is provided downstream of the feeding roller in the transport direction and that is configured to switch between a restriction posture in which the restricting member restricts movement of the medium and a retreat posture in which the restricting member permits the movement of the medium;

a first motor configured to generate power for rotating the feeding roller;

a second motor configured to generate power for switching a posture of the restricting member;

a transport roller that is provided downstream of the feeding unit in the transport direction and that transports the medium; and a one-way clutch on a transfer path on which power of the second motor is transferred to the restricting member, wherein an operation of rotating the feeding roller and an operation of switching the restricting member from the restriction posture to the retreat posture are performed in parallel, and when the second motor rotates forward, the transport roller rotates in a direction in which the medium is transported whereas the one-way clutch does not transfer the power of the second motor to the restricting member.

8. A medium-transporting device comprising:

a medium-mounting section on which a medium is mounted;

a feeding unit that includes a feeding roller for feeding the medium mounted on the medium-mounting section in a transport direction and that is configured to be displaced between a contact posture in which the feeding roller comes into contact with the medium mounted on the medium-mounting section and a separation posture in which the feeding roller separates from the medium;

a restricting member that is provided downstream of the feeding roller in the transport direction and that is configured to switch between a restriction posture in which the restricting member restricts movement of the medium and a retreat posture in which the restricting member permits the movement of the medium;

a first motor configured to generate power for rotating the feeding roller; and a second motor configured to generate power for switching a posture of the restricting member, wherein an operation of rotating the feeding roller and an operation of switching the restricting member from the restriction posture to the retreat posture are performed in parallel, and the restricting member includes a first restricting member and a second restricting member that is provided at a position at which a distance between a center point in a width direction intersecting the transport direction and the second restricting member is longer than a distance between the center point and the first restricting member, and the second restricting member switches from the restriction posture to the retreat posture at a timing after the first restricting member switches from the restriction posture to the retreat posture.

9. The medium-transporting device according to claim 8, wherein when the restricting member is in the restriction posture, the first restricting member is positioned downstream of the second restricting member in the transport direction.

10. The medium-transporting device according to claim 8, wherein the first restricting member is configured to come into contact with a contact section of the feeding unit, and when the first restricting member shifts from the retreat posture to the restriction posture and comes into contact with the contact section, the feeding unit takes the separation posture.

* * * * *